US007458672B2

(12) United States Patent
Hirakawa

(10) Patent No.: US 7,458,672 B2
(45) Date of Patent: Dec. 2, 2008

(54) IMAGE FORMING APPARATUS

(75) Inventor: Takashi Hirakawa, Kanagawa (JP)

(73) Assignee: Fijifilm Corporation, Tokyo (JP)

( * ) Notice: Subject to any disclaimer, the term of this patent is extended or adjusted under 35 U.S.C. 154(b) by 447 days.

(21) Appl. No.: 11/386,778

(22) Filed: Mar. 23, 2006

(65) Prior Publication Data

US 2006/0214984 A1 Sep. 28, 2006

(30) Foreign Application Priority Data

Mar. 24, 2005 (JP) ..... 2005-086951

(51) Int. Cl.
*B41J 2/01* (2006.01)

(52) U.S. Cl. ..... 347/101; 347/102

(58) Field of Classification Search ..... 347/104, 347/103, 101, 102

See application file for complete search history.

(56) References Cited

U.S. PATENT DOCUMENTS 5,640,655 A 6/1997 Shoji
6,719,423 B2 * 4/2004 Chowdry et al. ..... 347/103
6,820,975 B2 * 11/2004 Sugaya et al. ..... 347/104
7,237,887 B2 * 7/2007 Ueki et al. ..... 347/101

FOREIGN PATENT DOCUMENTS

JP 9-15981 A 1/1997
JP 2001-179959 A 7/2001

* cited by examiner

*Primary Examiner*—Stephen D Meier
*Assistant Examiner*—Ly T Tran
(74) *Attorney, Agent, or Firm*—Birch, Stewart, Kolasch & Birch, LLP

(57) ABSTRACT

The image forming apparatus comprises: an object liquid ejection device which ejects object liquid containing coloring material and solvent, onto a recording medium; a separating device which separates the coloring material and the solvent in the object liquid ejected on the recording medium; and a solvent removal device including an absorbing body which absorbs the solvent, the absorbing body being pressed against the object liquid in which the coloring material and the solvent are separated by the separating device, wherein an elastic modulus $E_n$ of the absorbing body in a pressing direction in which the absorbing body is pressed against the object liquid ejected on the recording medium, and an elastic modulus $E_s$ of the absorbing body in an orthogonal direction perpendicular to the pressing direction, satisfy the following relationship: $E_n<E_s$.

2 Claims, 15 Drawing Sheets

IMAGE FORMING APPARATUS

BACKGROUND OF THE INVENTION

1. Field of the Invention

The present invention relates to an image forming apparatus, and more particularly, to an absorbing body which absorbs a solvent component from an object liquid containing a coloring material component and the solvent component.

2. Description of the Related Art

In recent years, inkjet recording apparatuses (inkjet printers) have become widespread as image forming apparatuses for printing images. An inkjet recording apparatus prints a desired image by ejecting ink droplets from an inkjet recording head, onto a recording medium, such as a sheet of recording paper, while the recording medium and the inkjet recording head are moved relatively with respect to each other. From the viewpoint of preventing bleeding, and the like, in an inkjet recording apparatus of this kind, it is desirable that the ink droplets deposited on the recording medium be dried quickly, so that the image is fixed rapidly on the recording medium. Furthermore, if all of the ink droplets deposited on the recording medium are dried, then the printed regions on the recording medium may rise up in a projecting fashion, and this may be undesirable depending on the use of the printed object. In view of these circumstances, several technologies have been proposed for absorbing a portion of the ink deposited on a recording medium.

For example, Japanese Patent Application Publication No. 9-15981 discloses a surplus developer liquid removal device comprising a liquid absorbing body which removes surplus developer liquid deposited onto an image carrier body. This liquid absorbing body is constituted by a surface layer which is permeability to air and has a prescribed surface energy, and an elastic porous layer formed beneath the surface layer, in such a manner that the carrier liquid can be removed selectively from the surplus developer liquid.

Furthermore, Japanese Patent Application Publication No. 2001-179959 discloses an ink absorbing body comprising: a liquid solvent absorbing body which absorbs the liquid solvent of ink; and a release member which has release characteristics with respect to the coloring agent in the ink, but which transmits the liquid solvent of the ink.

As described above, several devices for removing solvent component from an object liquid by absorbing it with an absorbing body have been proposed, but there has not yet been a proposal for a device which focuses on the anisotropy of the elastic modulus of the absorbing body. The elastic modulus of an absorbing body is a factor which affects the strength and direction of the impact force that occurs when the absorbing body is pressed against the object liquid. For example, if a strong impact force occurs when the absorbing body is placed in contact with the object liquid, then the coloring material component included in the object liquid may be deformed, and the contact surface area between the coloring material component and the absorbing body may become larger than necessary. If the contact surface area between the coloring material component and the absorbing body becomes large, then adherence of the coloring material component to the absorbing body may still occur even if the coloring material component having excellent releasability with respect to the solvent component is used. Furthermore, if the absorbing body is displaced in the horizontal direction when it is pressed against the object liquid, then the coloring material component may be trailed or rubbed away by the absorbing body.

SUMMARY OF THE INVENTION

The present invention has been contrived in view of the aforementioned circumstances, an object thereof being to provide technique which prevents an absorbing body from giving an excessive effect on a coloring material component contained in an object liquid when the absorbing body is pressed against the object liquid.

In order to attain the aforementioned object, the present invention is directed to an image forming apparatus, comprising: an object liquid ejection device which ejects object liquid containing coloring material and solvent, onto a recording medium; a separating device which separates the coloring material and the solvent in the object liquid ejected on the recording medium; and a solvent removal device including an absorbing body which absorbs the solvent, the absorbing body being pressed against the object liquid in which the coloring material and the solvent are separated by the separating device, wherein an elastic modulus $E_n$ of the absorbing body in a pressing direction in which the absorbing body is pressed against the object liquid ejected on the recording medium, and an elastic modulus $E_s$ of the absorbing body in an orthogonal direction perpendicular to the pressing direction, satisfy the following relationship: $E_n<E_s$.

The force which is given to the absorbing body when the absorbing body is pressed against the object liquid, is delivered in the pressing direction as well as in the orthogonal direction. Accordingly, if the elastic modulus of the absorbing body in a pressing direction in which the absorbing body is pressed against the object liquid is larger than the elastic modulus of the absorbing body in a direction perpendicular to the pressing direction, then the displacement of the absorbing body in the orthogonal direction during pressing the absorbing body against the object liquid can be effectively reduced. Consequently, the absorbing body is prevented from being moved in the horizontal direction with respect to the coloring material on the recording medium, and therefore the distortion of the image can be suppressed. The term "a pressing direction in which an absorbing body is pressed against an object liquid" here may correspond to a direction of the normal line to a part of the recording medium where the object liquid is deposited, for example. The term "an orthogonal direction" here may correspond to a direction of the conveyance of the recording medium. The separating device may adopt any separation method by which the coloring material and the solvent in the object liquid can be separated. For example, the separating device can adopt separation methods based on a chemical reaction or an electrostatic force.

Preferably, the absorbing body includes a surface layer which makes direct contact with the object liquid and a supporting layer which supports the surface layer; and an elastic modulus $E_{n1}$ of the surface layer in the pressing direction and an elastic modulus $E_{n2}$ of the supporting layer in the orthogonal direction satisfy the following relationship: $E_{n1}<E_{n2}$.

According to this aspect, the absorbing body is constituted by combining the surface layer and the supporting layer, and hence it is possible to ensure the elasticity of the absorbing body in the pressing direction and the orthogonal direction required in the present invention relatively easily.

According to the present invention, when the absorbing body is pressed against the object liquid, it is possible to suppress the amount of displacement of the absorbing body in "the orthogonal direction which is perpendicular to the pressing direction against the object liquid". Accordingly, when the absorbing body is pressed against the object liquid, then it is possible to effectively prevent the absorbing body from applying an excessive force to the coloring material contained in the object liquid, in a direction perpendicular to the pressing direction.

BRIEF DESCRIPTION OF THE DRAWINGS

The nature of this invention, as well as other objects and advantages thereof, will be explained in the following with reference to the accompanying drawings, wherein.

DETAILED DESCRIPTION OF THE PREFERRED EMBODIMENTS

Below, the embodiments of the present invention are described with reference to the accompanying drawings. The embodiments described below relate to examples where the present invention is applied to an inkjet recording head.

First Embodiment

In the present embodiment, a radiation-curable ink containing a coloring material and a solvent is used. This radiation-curable ink is separated into a coloring material component and a solvent component by reaction with a treatment liquid. A portion of the solvent component is absorbed by a solvent absorbing body, while the remaining radiation-curable ink is fixed by irradiation of radiation. Consequently, the radiation-curable ink is cured in a flattened state on the recording medium.

Figure 1:
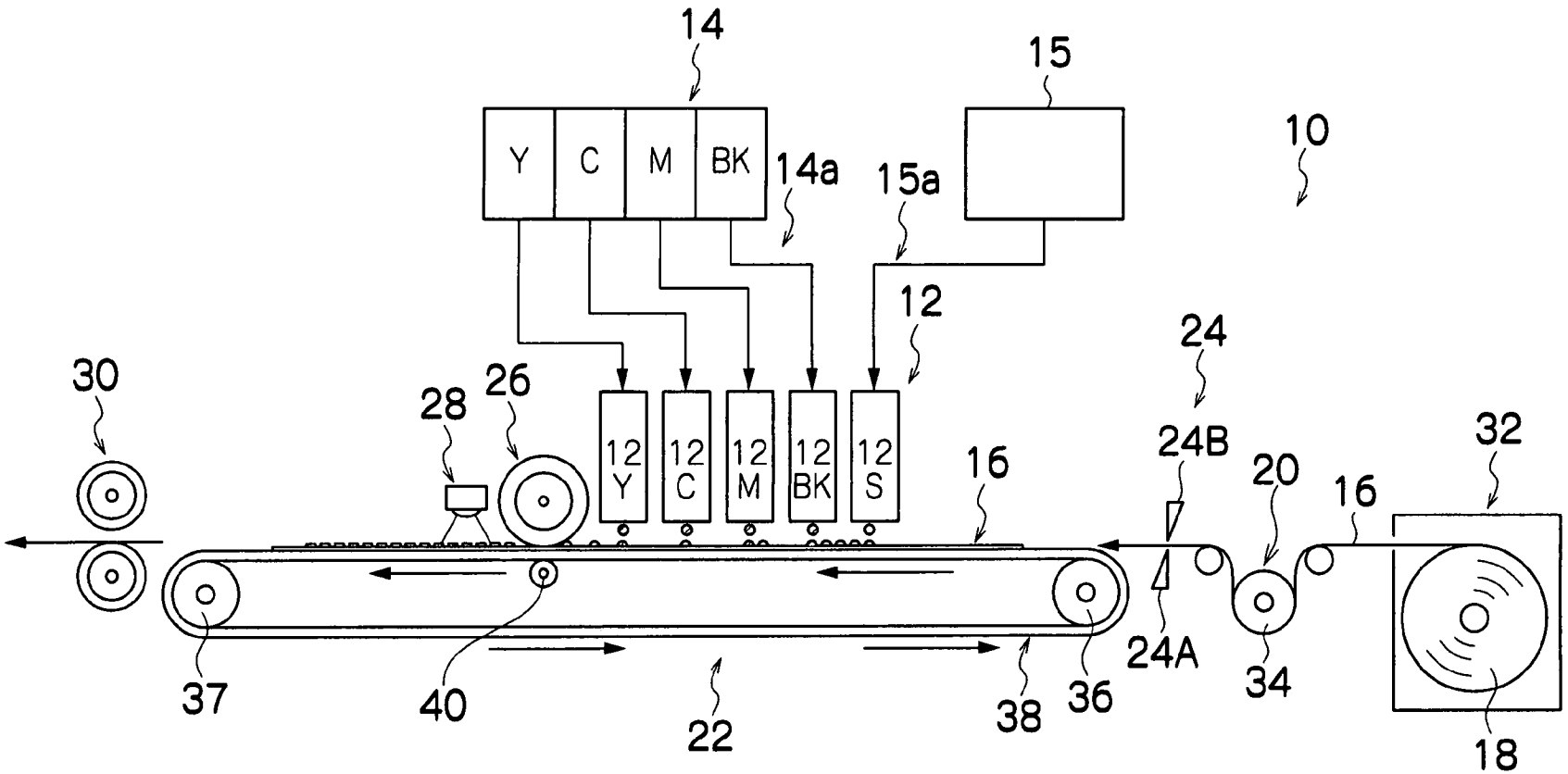
FIG. 1 shows a general view of the overall composition of an inkjet recording apparatus in a first embodiment of the present invention.

FIG. 1 shows a general view of the overall composition of an inkjet recording apparatus 10 according to a first embodiment of the present invention. The inkjet recording apparatus 10 according to this embodiment comprises: a paper supply unit 18 which supplies recording paper 16; a decurling unit 20 provided after the paper supply unit 18; a cutter 24 provided after the decurling unit 20; a print unit 12 provided after the cutter 24; a solvent absorbing roller 26 provided after the print unit 12; a radiation source 28 provided after the solvent absorbing roller 26; a paper output unit 30 provided after the radiation source 28; and a belt conveyance unit 22 which conveys recording paper 16 between the cutter 24 and the paper output unit 30.

The paper supply unit 18 is shown as comprising a magazine 32 for rolled paper (continuous paper) in the example shown in FIG. 1; however, a plurality of magazines holding papers of different properties, such as paper width and quality, may be provided. Furthermore, a cassette in which cut paper is stacked and loaded may also be used instead of, or in conjunction with, the magazine 32 of rolled paper, and recording paper 16 may also be supplied by means of this cassette. In the case of a composition in which a plurality of different types of recording papers 16 can be used, it is also possible to attach an information recording body, such as a barcode or wireless tag, which records information on the type of recording paper 16, to the magazine. In this case, desirably, the type of recording paper 16 used is identified automatically by reading in the type information recorded on the information recording body, by means of a prescribed reading apparatus, and ink ejection is controlled in such a manner that suitable ink ejection is achieved in accordance with the type of recording paper 16 thus identified.

The decurling unit 20 is provided between the paper supply unit 18 and the print unit 12, and it removes curl from the recording paper 16. The recording paper 16 delivered from the paper supply unit 18 retains curl due to having been loaded in the magazine 32. In order to remove the curl, heat is applied to the recording paper 16 in the decurling unit 20 by a heating drum 34, in the direction opposite to the curl direction by the magazine 32. In this case, desirably, the heating temperature applied to the recording paper 16 is adjusted in such a manner that the printing surface of the recording paper 16 forms a slightly outward curl.

The cutter 24 is provided between the decurling unit 20 and the belt conveyance unit 22. If roll paper is used for the recording paper 16 as shown in FIG. 1, then the cutter 24 is used to cut the recording paper 16. The rolled paper is cut to a prescribed size by the cutter 24. The cutter 24 according to the present embodiment comprises a stationary blade 24*a* having a length equal to or exceeding the width of the conveyance path of the recording paper 16, and a circular blade 24B which move along the stationary blade 24A. The stationary blade 24A is disposed on the rear side of the print surface of the recording paper 16, and the circular blade 24B is disposed on the front side of the print surface of the recording paper 16, on the other side of the conveyance path of the recording paper 16, from the stationary blade 24A. If only cut paper is used as the recording paper 16, then the cutter 24 is not necessary. The cut recording paper 16 is delivered to the belt conveyance unit 22.

The print unit 12 has a plurality of heads which eject liquid onto the recording paper 16 forming a recording medium. More specifically, the print unit 12 comprises a plurality of print heads (ink heads) 12BK, 12M, 12C and 12Y provided for respective ink colors, and a treatment liquid head 12S which ejects treatment liquid. The print heads (ink heads) 12BK, 12M, 12C and 12Y are connected to an ink storing and loading unit 14, and the treatment liquid head 12S is connected to a treatment liquid tank 15.

The ink storing and loading unit 14 has ink tanks for storing the inks of colors (BK (black), M (magenta), C (cyan) and Y (yellow)) corresponding to the print heads 12BK, 12M, 12C and 12Y, and the ink tanks are connected to the print heads 12BK, 12M, 12C and 12Y via tubing channels 14*a*. Furthermore, the ink storing and loading unit 14 has a warning system, such as a display device or an alarm generating device, for generating a warning when the remaining amount of ink inside the ink tank has become low, and it also has a mechanism for preventing confusion between the loadings of different colors. The ink stored in the ink storing and loading unit 14 of the present embodiment is a radiation curable ink which is cured by being irradiated with radiation such as ultraviolet light (UV) or an electron beam (EB).

The treatment liquid tank 15 stores treatment liquid to be supplied to the treatment liquid head 12S and is connected to the treatment liquid head 12S via a tubing channel 15*a*. Furthermore, the treatment liquid tank 15 also has a warning system for issuing a warning by means of an image display or sound, when the remaining amount of treatment liquid has become low. The treatment liquid stored in the treatment liquid tank 15 generates aggregates of the ink coloring material in the ink by reacting with the ink, and thus serves to separate the coloring material component and the solvent component. The details of the separation reaction between the coloring material component and the solvent component in the ink due to the treatment liquid are described later.

The solvent absorbing roller 26 serves to absorb and remove the solvent component which has been separated from the coloring material component by the reaction between the ink and the treatment liquid. An auxiliary roller 40 is provided at a position opposing the solvent absorbing roller 26, on the other side of the conveyance belt 38 which conveys the recording paper 16, from the solvent absorbing roller 26. The details of the solvent absorbing roller 26 and the auxiliary roller 40 are described later (see FIG. 7).

The radiation source 28 irradiates radiation onto the ink from which a portion of the solvent component has been removed by the solvent absorbing roller 26, and thereby the ink is cured. The radiation emitted by the radiation source 28 is specified in accordance with the curing properties of the ink. For example, if the ink is a UV (ultraviolet light)-curable ink, then a UV light source is used for the radiation source 28.

The paper output unit 30 takes the recording paper 16 (printed object) which has been conveyed from the radiation source 28 by the belt conveyance unit 22 and on which a desired image has been formed, and outputs it from the inkjet recording apparatus 10. A sorter (not shown) for collecting images according to print orders is provided in the paper output unit 30.

The belt conveyance unit 22 is disposed so as to oppose the nozzle surfaces of the heads 12BK, 12M, 12C, 12Y and 12S which constitute the print unit 12, and it conveys the recording paper 16 from the cutter 24 toward the paper output unit 30, while keeping the recording paper 16 flat. This belt conveyance unit 22 has a structure in which an endless conveyance belt (electrostatic attraction belt) 38 is wound between two rollers 36 and 37, in such a manner that the conveyance surface of the conveyance belt 38 forms a flat surface extending in the horizontal direction, at least in a position opposing the nozzle surfaces of the heads 12BK, 12M, 12C, 12Y and 12S.

The conveyance belt 38 is an electrostatic attraction type of belt, and the recording paper 16 is conveyed while being attracted to and fixed on the surface of the conveyance belt 38 by means of an electrostatic force. The conveyance belt 38 is constituted by a conducting member, and is connected electrically to a DC power supply (not shown). The drive force of a motor (not shown) is transmitted to at least one of the rollers 36 and 37 about which the conveyance belt 38 is wound, thereby driving the conveyance belt 38 shown in FIG. 1 in the counterclockwise direction in FIG. 1. Consequently, the recording paper 16 is conveyed from the right to the left in FIG. 1, while being held on the conveyance belt 38.

The print heads 12BK, 12M, 12C and 12Y are each full line heads having a length corresponding to the maximum width of the recording paper 16 used with the inkjet recording apparatus 10, and comprising a plurality of nozzles for ejecting ink arranged on a nozzle surface through a length exceeding at least one edge of the maximum-size recording paper 16 (namely, the full width of the printable range). Furthermore, the treatment liquid head 12S is also a full line head in which a plurality of nozzles are arranged, similarly to the print heads 12BK, 12M, 12C and 12Y.

The print heads 12BK, 12M, 12C and 12Y shown in FIG. 1 are disposed in the order, black (BK), magenta (M), cyan (C) and yellow (Y), from the upstream side to the downstream side of the conveyance direction of the recording paper 16. The print heads 12BK, 12M, 12C and 12Y are fixed and installed in such a manner that they extend in a direction (main scanning direction) which is substantially perpendicular to the conveyance direction of the recording paper 16 (the sub-scanning direction).

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the paper conveyance direction (sub-scanning direction) just once (in other words, by means of a single sub-scan). Therefore, compared to a shuttle head which moves back and forth reciprocally in a direction (main scanning direction) which is perpendicular to the paper conveyance direction, the print unit 12 according to the present embodiment, which includes full line heads, is capable of printing at higher speed onto the recording paper 16 and therefore image productivity can be improved.

The terms "main scanning direction" and "sub-scanning direction" here are used in the following senses. In a full-line head having a row of nozzles which corresponds to the full width of the printing paper, the nozzles are driven in one of the following ways: (1) all of the nozzles are driven simultaneously; (2) the nozzles are drive successively from one side towards the other side; and (3) the nozzles are divided up into blocks and are driven successively in these blocks, from one side towards the other. The driving of the nozzles in order to print a single line or a single band in the width direction of the printing paper (the direction orthogonal to the direction of conveyance of the printing paper) is defined as a "main scanning". The direction indicated by one line or one band-shaped line recorded by the main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning, while the full-line head and the recording paper are moved relatively to each other. The direction in which sub-scanning is performed is called the "sub-scanning direction". Consequently, the conveyance direction of the recording paper corresponds to the sub-scanning direction and the direction perpendicular to same corresponds to the main scanning direction.

Although a configuration with four standard colors, K M C and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

Next, the structure of the print heads 12BK, 12M, 12C and 12Y will be described. The print heads 12BK, 12M, 12C and 12Y all have a common structure, and therefore the reference numeral 50 is used to refer to a representative example of the print heads 12K, 12C, 12M and 12Y.

Figure 2A:
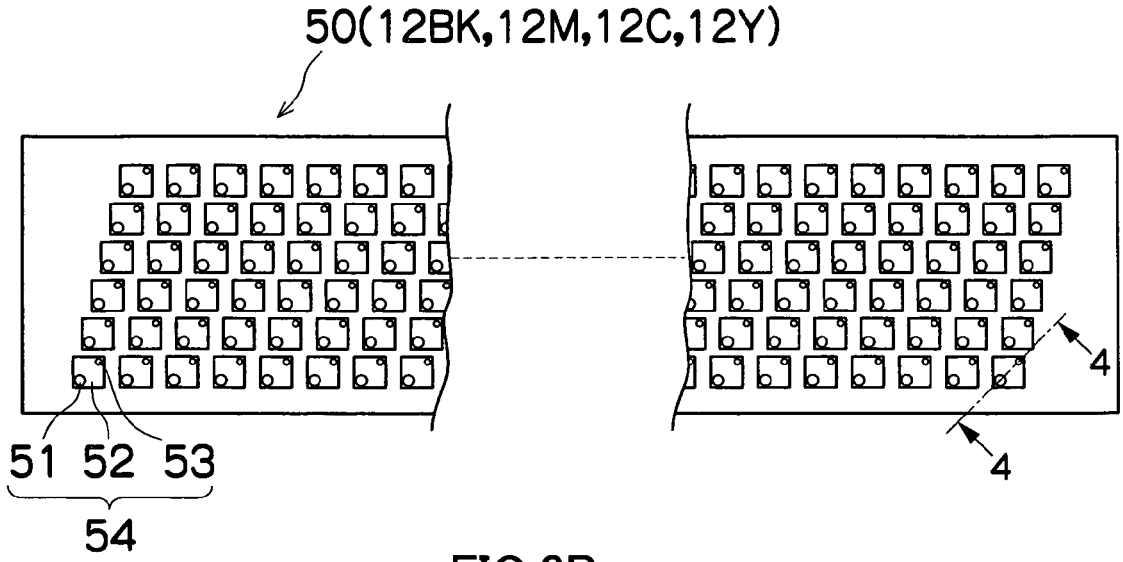
FIG. 2A is a plan view perspective diagram showing an example of the composition of a print head.
Figure 2B:
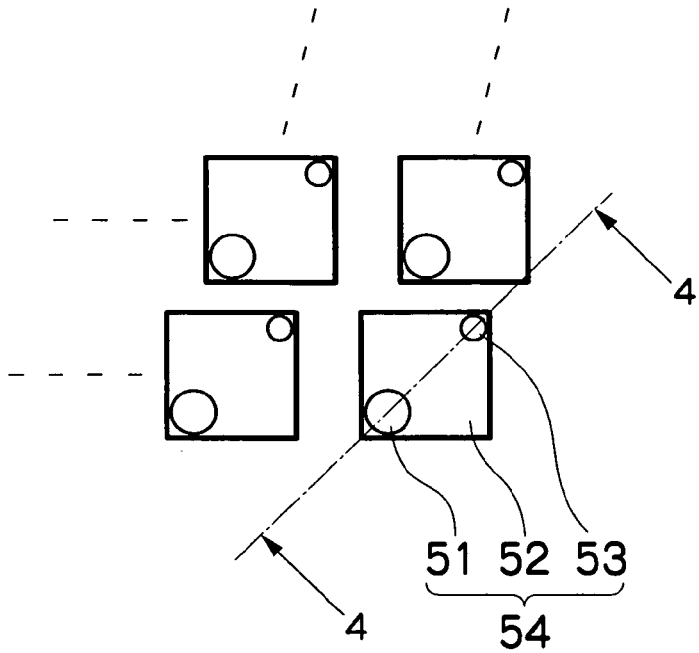
FIG. 2B is an enlarged diagram of a portion of FIG. 2A.

FIG. 2A is a plan view perspective diagram showing an example of the composition of a print head 50, and FIG. 2B is an enlarged diagram of a portion of FIG. 2A. In the print head 50 according to the present embodiment, as shown in FIG. 2A, pressure chamber units 54 are arranged at high density in a staggered two-dimensional matrix array. Each of these pressure chamber units 54 includes a nozzle 51 which ejects ink in the form of liquid droplets, a pressure chamber 52 which applies a pressure to the ink contained therein when ink is to be ejected, and an ink supply port 53 for supplying ink to the pressure chamber 52 from a common flow channel (see reference numeral 55 in FIG. 4).

Furthermore, as shown in FIG. 2B, each of the pressure chambers 52 has an approximately square planar shape when viewed from above. A nozzle 51 is formed at one end of a diagonal of each pressure chamber 52, and an ink supply port 53 is provided at the other end thereof. The planar shape of the pressure chamber 52 is not limited to being a square shape.

Figure 3:
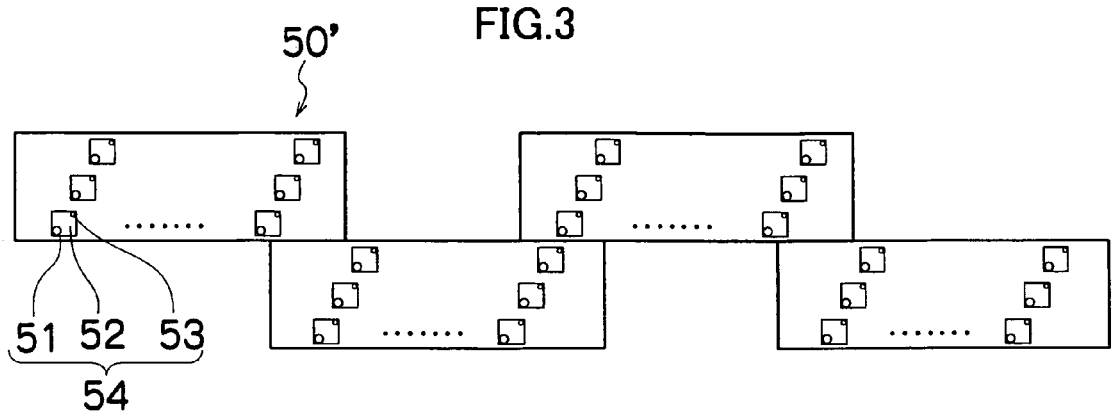
FIG. 3 is a plan view perspective diagram showing a further example of the structure of a print head.

FIG. 3 is a plan view perspective diagram showing a further example of the structure of the print head. As shown in FIG. 3, one long full line head may be constituted by combining a plurality of short heads 50' arranged in a two-dimensional staggered array, in such a manner that the combined length of the plurality of short heads 50' corresponds to the full width of the print medium.

Figure 4:
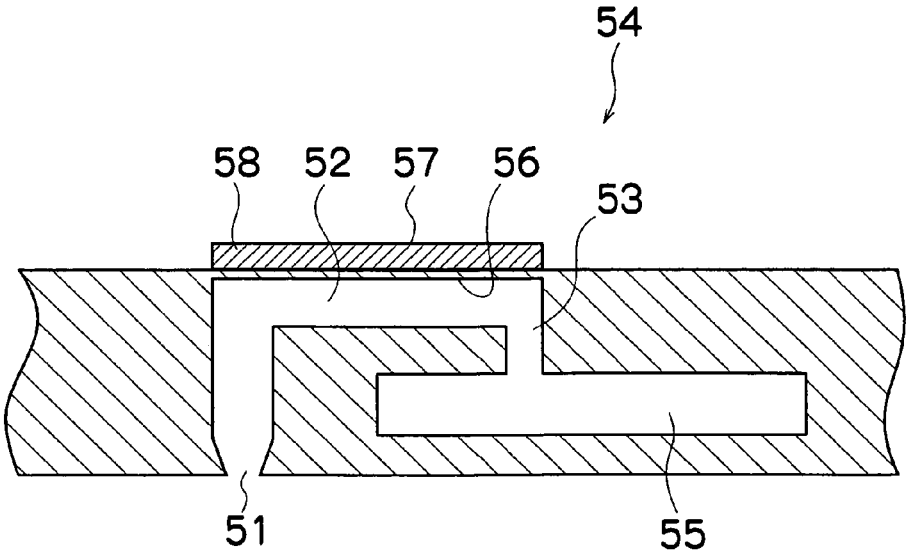
FIG. 4 is a cross-sectional diagram along line 4-4 in FIGS. 2A and 2B, and shows a side cross-section of one pressure chamber unit.

FIG. 4 is a cross-sectional diagram along line 4-4 in FIGS. 2A and 2B, and it shows a side cross-section of one pressure chamber unit 54. The pressure chamber 52 is provided so as to correspond to a nozzle 51, and is connected to the nozzle 51 as well as a common flow channel 55 via an ink supply port 53. The common flow channel 55 is connected to an ink tank of the ink storing and loading unit 14 which forms an ink supply source. The ink supplied from the ink tank is divided and supplied to each of the pressure chambers 52 via the common flow channel 55.

The ceiling faces of the pressure chambers 52 are constituted by a thin diaphragm 56, and piezoelectric elements (piezoelectric actuators) 58 provided with individual electrodes 57 are bonded to the diaphragm 56. The diaphragm 56 also serves as a common electrode. By applying a drive voltage to the individual electrode 57 and the common electrode (diaphragm) 56, the piezoelectric element 58 is deformed and the volume of the pressure chamber 52 changes. The pressure of the ink inside the pressure chamber 52 changes due to the change in the volume of the pressure chamber 52, and thereby the ink is caused to be ejected from the nozzle 51. After ink is ejected, new ink is filled into the pressure chamber 52 from the common flow channel 55 through the ink supply port 53, in preparation for the next ejection of ink.

Figure 5:
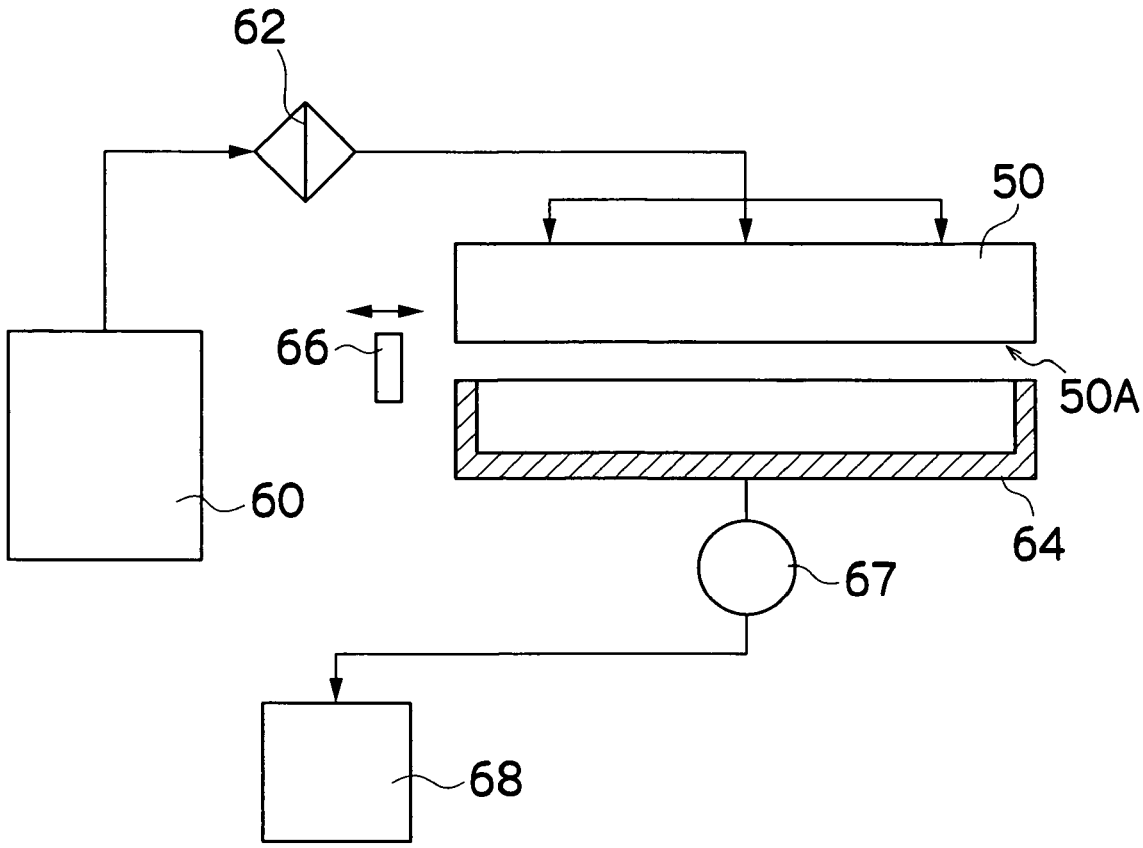
FIG. 5 is an approximate diagram showing the composition of an ink supply system in the inkjet recording apparatus.

Next, the composition of the ink supply system will be described. FIG. 5 is a conceptual diagram showing the composition of an ink supply system in the inkjet recording apparatus 10.

The ink tank 60 is a base tank that supplies ink to the print head 50 and is set in the ink storing and loading unit 14 described in FIG. 1. The types of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type.

A filter 62 is provided in the channel which connects the ink tank 60 with the print head 50. The filter 62 is a cleaning filter for removing air bubbles and foreign material contained in the ink flowing through an ink conveyance channel 100, and has the form of a mesh. The mesh size of the filter 62 is desirably equal to or smaller than the nozzle diameter in the print head 50, and for example, the filter mesh size can be set to approximately 20 μm.

It is also possible to provide a sub-tank (not shown) in the vicinity of the print head 50, or in an integrated fashion with the print head 50. This sub-tank has a damping function of preventing internal pressure fluctuations in the head, and a function of improving refilling.

The inkjet recording apparatus 10 also has a cap 64 of a size which covers the nozzle surface 50A of the print head 50, and a recovery tank 68 connected to the cap 64 via a recovered ink conveyance channel 69. A cleaning blade 66 formed by an elastic member made of rubber, or the like, is provided in the vicinity of the cap 64, and the recovered ink conveyance channel 69 is provided with a suction pump 67.

The cap 64 is provided raisably to a prescribed raised position, by means of an elevator mechanism (not shown). When the power supply is switched off, or during standby for printing, the cap 64 is lowered with respect to the print head 50. When disposed in the prescribed raised position, the cap 64 covers the nozzle region of the nozzle surface 50A while making close contact with the print head 50, and thereby the drying of the nozzle surface 50A and an increase in the viscosity of the ink in the vicinity of the nozzles are prevented. On the other hand, the cleaning blade 66 is provided in such a manner that it can slide over the nozzle surface 50A, which is the ink ejection surface of the print head 50, by means of a blade movement mechanism (not shown). If unnecessary ink droplets or foreign material has become attached to the nozzle surface 50A, then so-called "wiping" is performed by the cleaning blade 66 which slides over the nozzle surface 50A, and thereby ink droplets and foreign material adhering to the nozzle surface 50A and cleaning the nozzle surface 50A are wiped away. A porous member, such as a sponge, or the like, which functions as an ink receptacle, is provided on the inner side of the cap 64, and the ink suctioned or ejected toward the cap 64 flows into the recovery ink conveyance channel 69 via the ink receptacle formed by this porous member.

In this way, the cap 64 and cleaning blade 66 constitute a maintenance unit which cleans the nozzle surface 50A, and they are provided so as to be moved in a relative fashion with respect to the print head 50, by means of movement mechanisms (not shown). The cap 64 and cleaning blade 66 are moved, as required, to a maintenance position below the print head 50, from a prescribed withdrawal position. For example, if the use frequency of a particular nozzle 51 has declined and the ink viscosity in the vicinity of the nozzle 51 has increased, then preliminary ejection is performed toward the cap 64 in order to remove the degraded ink from the nozzle 51. Furthermore, if air bubbles enter into the ink inside the print head 50 (for example, into the pressure chambers 52), then the print head 50 is capped with the cap 64, and the ink inside the print head 50 is suctioned by the suction pump 67 and sent to the recovery tank 68. If it is expected that deterioration of the ink inside the print head 50 has progressed, for instance, in a case where new ink is loaded into the print head 50 by replacing ink tanks, or the like, or in a case where the inkjet recording apparatus 10 starts to be used after having been out of use for a long period of time, then it is possible to remove the degraded ink from the print head 50 by carrying out the "capping and ink suction" operation described above.

In other words, if the print head 50 remains in a state of not ejecting ink for a prescribed period of time or longer, then the viscosity of the ink increases due to evaporation of the ink solvent in the vicinity of the nozzles 51, and therefore it may become difficult to eject ink from the nozzles 51, even if the ejection driving actuators are actuated. Therefore, the actuators 111 are operated before it becomes difficult to eject ink, thus performing a "preliminary ejection" which ejects the ink in the vicinity of the nozzles 51, which has increased in viscosity, toward the ink receptacle in the cap 64. Furthermore, by performing "preliminary ejection" after carrying out wiping of the nozzle surface 50A by the cleaning blade 66, then it is possible to prevent foreign material, and the like, which has entered into the nozzles 51 due to the wiping action, from remaining inside the nozzles 51. The term "preliminary ejection" may also be known generally as "blank ejection", "purging", or "flushing".

The ink suctioning by the suction pump 67 is carried out with respect to all of the ink inside the pressure chambers 52 of the print head 50, and therefore it consumes a large amount of ink. Therefore, desirably, the preliminary ejection is carried out while the increase in the viscosity of ink in the print head 50 is still minor. Furthermore, desirably, partitions are disposed on the inside of the cap 64, and the nozzle surface 50A is divided into a plurality of areas corresponding to nozzle columns by means of these partitions, in such a manner that the respective areas of the nozzle surface 50A divided by the partitions can be suctioned selectively, on the basis of a selector, or the like.

Figure 6:
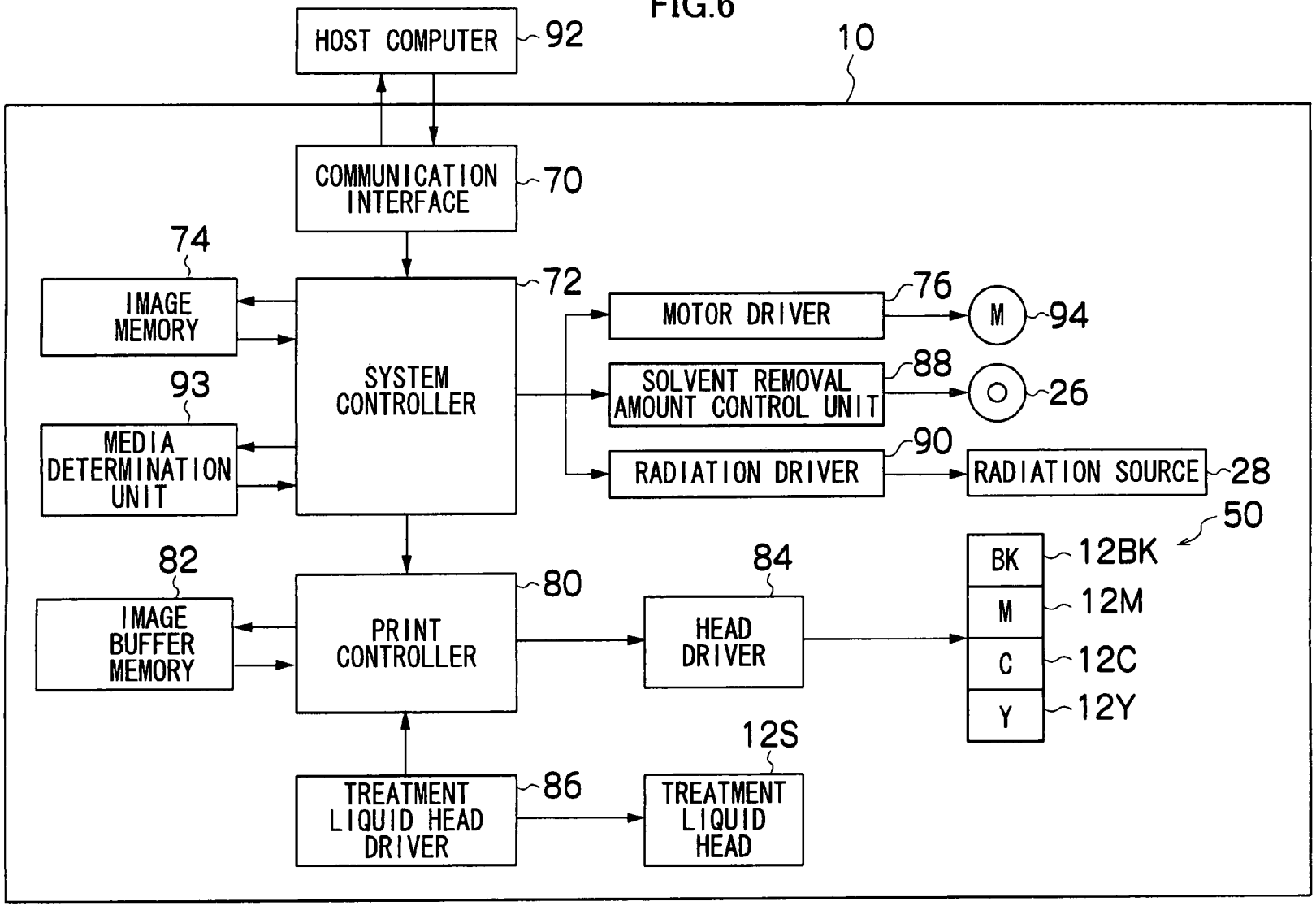
FIG. 6 is a principal block diagram showing the system composition (control system) in the inkjet recording apparatus.

FIG. 6 is a principal block diagram showing the system composition (control system) of the inkjet recording apparatus 10. The inkjet recording apparatus 10 also comprises a communication interface 70, a system controller 72, an image memory 74, a motor driver 76, a print controller 80, an image buffer memory 82, a head driver 84, a treatment liquid head driver 86, a solvent removal amount control unit 88, a radiation driver 90, and the like.

The communication interface 70 constitutes an interface section with the external devices, and it receives image data sent by a host computer 92, for example. As the communication interface 70, a serial interface, such as USB, IEEE 1394, Ethernet, or a wireless network, or the like, or a parallel interface, such as a Centronics interface, or the like, can be used, for example. Furthermore, a buffer memory (not shown) for increasing the communication speed may be installed in the communication interface 70. The data, such as image data, sent by an external device, such as the host computer 92, is read into the system controller 72 via the communication interface 70 and is stored temporarily in the image memory 74.

The image memory 74 is a storage unit for temporarily storing data, such as image data, input via the communication interface 70, and data is written to and read from the image memory 74 via the system controller 72. The image memory 74 is not limited to a memory including a semiconductor element, and a magnetic medium, such as a hard disk, or the like, may also be used.

The system controller 72 is a control unit for controlling the communication interface 70, image memory 74, motor driver 76, solvent removal amount control unit 88, radiation driver 90, and the like. The system controller 72 is constituted by a central processing unit (CPU) and peripheral circuits thereof, and it generates control signals for controlling communications between the host computer 92 and the system control unit 115, controlling the reading and writing of data from and to of the image memory 74, and controlling the media determination unit 93, solvent absorbing roller 26 and radiation source 28, and the like.

The motor driver 76 is a driver (drive circuit) which drives the motor 94 in accordance with instructions from the system controller 72. The radiation driver 90 is a driver which drives the radiation source 28 forming a curing device in accordance with instructions from the system controller 72. The solvent removal amount control unit 88 controls the solvent absorbing roller 26 and the auxiliary roller 40 in accordance with instructions from the system controller 72, and thereby the amount of solvent component absorbed and removed by the solvent absorbing roller 26 is adjusted. The concrete method by which the solvent absorbing roller 26 is controlled by the solvent removal amount control unit 88 is described hereinafter.

The print controller 80 is controlled by the system controller 72 and has a signal processing function for performing various treatment processes, corrections (compensations), and the like, in order to generate a signal (print control signal) for controlling printing on the basis of the image data stored in the image memory 74. The print controller 80 supplies the print control signal (print data) thus generated to the head driver 84. The print control signal generated by the print controller 80 includes information relating to the ejection volume and ejection timing of the ink droplets to be ejected from the print head 50. An image buffer memory 82 is connected with the print controller 80. Image data, parameters, and other data used for processing the image data in the print controller 80 are temporarily stored in the image buffer memory 82.

The head driver 84 drives the actuators 111 of the print heads 50 corresponding to the colors, on the basis of the print control signal (print data) supplied by the print controller 80. By this means, desired dot size and dot positions based on the print control signal can be achieved. The head driver 84 may also comprise a system which implements feedback control in order to stabilize the driving conditions of the print head 50.

Similarly to the head driver 84, the treatment liquid head driver 86 drives the ejection driving actuators of the treatment liquid head 12S on the basis of a treatment liquid ejection signal supplied by the print controller 80. Thereby, desired dot size and dot arrangement based on the treatment liquid ejection signal are achieved at prescribed positions of the recording paper 16. The treatment liquid head driver 86 may also comprise a system which implements feedback control in order to stabilize the driving conditions of the treatment liquid head 12S.

The media determination unit 93 identifies information, such as the type and size of the recording paper 16, and reports the information relating to the recording paper 16 thus identified, to the system controller 72 and the print controller 80. The information relating to the recording paper 16 reported to the system controller 72 and the print controller 80 is used to control ejection of the treatment liquid and ink, and to control the amount of solvent removed by the solvent absorbing roller 26. Any device capable of identifying the recording paper 16 is used as a media determination unit 93. For example, it is possible to use, as the media determination unit 93, either an apparatus which reads in information, such as a barcode, attached to the magazine 32 of the paper supply unit 18, an apparatus which automatically identifies the recording paper 16 by a sensor (paper width determination sensor, paper thickness determination sensor, paper reflectivity determination sensor, or the like), provided in an appropriate position in the conveyance path of the recording paper 16, or the combination of these apparatuses. Furthermore, instead of using an automatic identification apparatus of this kind, or in conjunction with an automatic identification apparatus of this kind, the media determination unit 93 may also be composed in such a manner that the recording paper 16 is identified on the basis of paper type and size information, and the like, input by a user or by another device, via a prescribed user interface.

The data of the image to be printed is input from an external device, such as a host computer 92, via the communication interface 70, and is stored in the image memory 74. At this stage, RGB image data is stored in the image memory 74, for example. The image data stored in the image memory 74 is sent to the print controller 80 through the system controller 72, and is converted into dot data for each ink color by a commonly known image processing method, such as a dithering method or an error diffusion method, in the print controller 80. The head driver 84 controls and drives the print heads 12BK, 12M, 12C and 12Y on the basis of the dot data thus obtained, and hence desired ink droplets are ejected from the print heads 12BK, 12M, 12C and 12Y. By causing ink droplets to be ejected from the print heads 12BK, 12M, 12C, 12Y in synchronization with the conveyance speed of the recording paper 16, a desired image is formed on the recording paper 16.

Next, a method for removing the solvent component from the ink on the recording paper 16 by means of the solvent absorbing roller 26 will be described.

Figure 7:
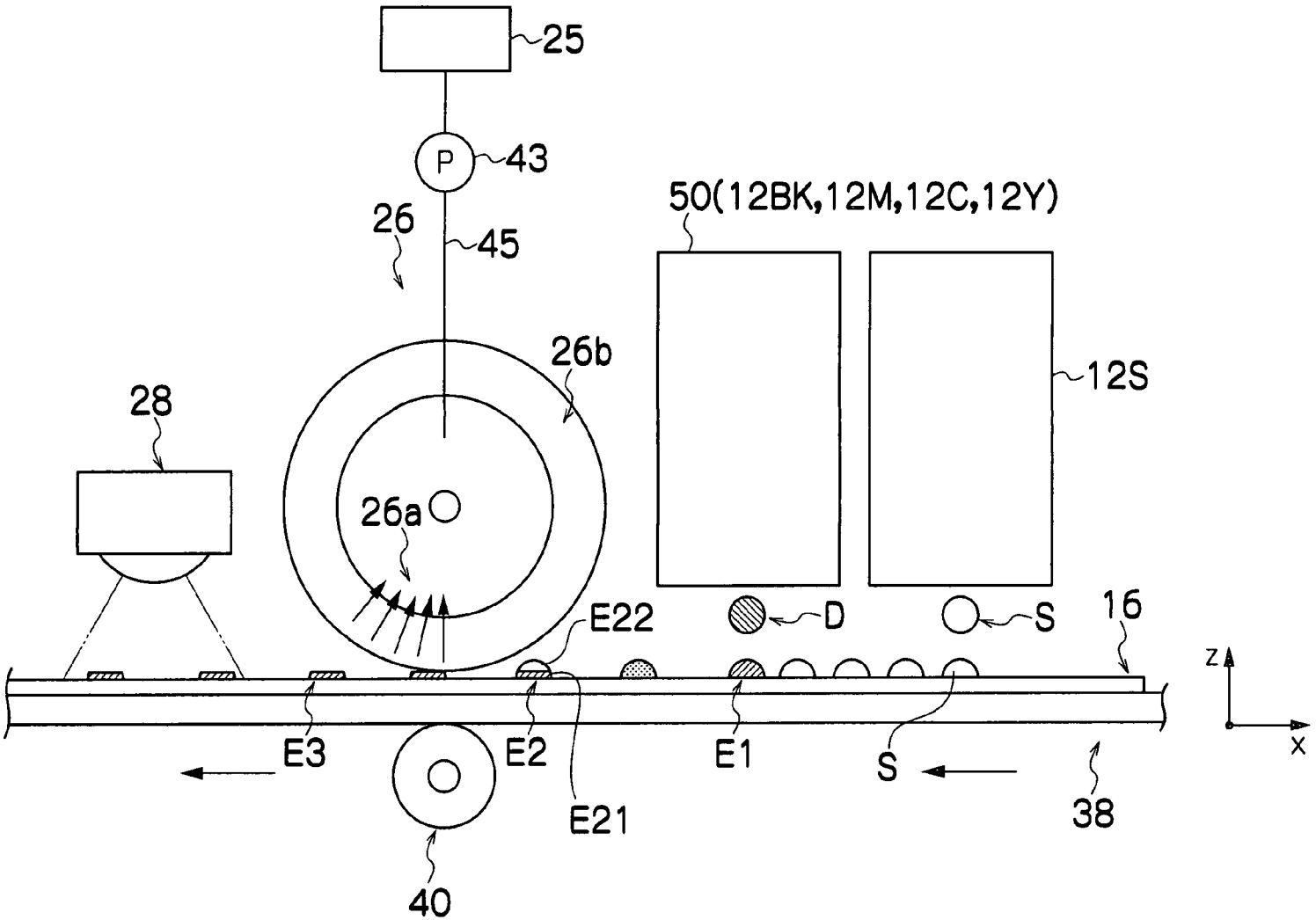
FIG. 7 is an enlarged diagram of the periphery of a print unit and a solvent removal roller.

FIG. 7 is an enlarged diagram of the periphery of the print unit 12 and the solvent absorbing roller 26. In order to simplify the description, in FIG. 7, the print heads 12BK, 12M, 12C and 12Y are represented by a single print head 50.

The recording paper 16 is mounted on the conveyance belt 38 and conveyed below the treatment liquid head 12S, the print head 50, the solvent absorbing roller 26 and the radiation source 28. The recording paper 16 is conveyed in the direction of the arrow shown in FIG. 7.

The treatment liquid head 12S ejects treatment liquid S before droplets of ink are ejected onto the recording paper 16 by the print head 50, and it ejects droplets of treatment liquid S onto positions of the recording paper 16 where the ink droplets from the print head 50 are expected to land (hereinafter, referred to as "ink droplet ejection positions"). With the movement of the conveyance belt 38, the recording paper 16 onto which treatment liquid S has been deposited is conveyed below the print head 50 from a position below the treatment liquid head 12S.

When the recording paper 16 is situated below the print head 50, the print head 50 ejects ink D onto the ink droplet ejection positions on the recording paper 16. In this case, since the treatment liquid S is previously applied onto the ink droplet ejection positions, the ink D ejected from the print head 50 mixes with the treatment liquid S, so that a mixed liquid E1 is produced on the recording paper 16.

The treatment liquid S in the present embodiment has properties whereby the coloring material component contained in the ink D is caused to aggregate, when it mixes with the ink D ejected from the print head 50. Accordingly, in the mixed liquid E1 on the recording paper 16, the treatment liquid S and the ink D react with each other, and thereby the coloring material component is caused to aggregate. The aggregate of the coloring material component sinks downward, and hence the mixed liquid E1 becomes a mixed liquid E2 in which a coloring material layer E21 comprising the aggregate of the coloring material component is separated from a solvent layer E22 comprising the solvent component. In this way, in the present embodiment, the function of mixing the treatment liquid S and the ink D corresponds to a separating device.

A desired combination of the treatment liquid S and ink D may be used, which causes separation of the coloring material component and solvent component in the ink D. For example, it is possible to use, as the ink D, a solvent containing a polymer containing negatively charged surface-active ions such as an anionic polymer, and as the treatment liquid S, a transparent reaction promoter containing a polymer containing positively charged surface-active ions such as a cationic polymer. Furthermore, combinations of ink D and treatment liquid S may be used in which breakdown of dispersion (aggregation) is caused by changing the pH of a pigment-based ink D by means of a treatment liquid S, or in which breakdown of dispersion in a pigment-based ink D is produced by means of a treatment liquid S which contains a multivalent metallic salt. Concrete examples of the treatment liquid S and the ink D are described later.

The solvent absorbing roller 26 includes a roller-shaped base roller 26*a* and an absorbing section 26*b* attached to the surface of the base roller 26*a* by adhesive. The absorbing section 26*b* forms a surface layer which makes direct contact with the ink on the recording paper 16, and the base roller 26*a* forms a supporting layer which supports the absorbing section 26*b*. The position of the solvent absorbing roller 26 is adjusted in such a manner that a very small gap is formed between the bottommost part of the solvent absorbing roller 26 and the recording paper 16. This solvent absorbing roller 26 rotates in the same direction as the direction of conveyance of the recording paper 16. In this case, the solvent absorbing roller 26 is rotated in such a manner that it has a relative speed of substantially zero with respect to the recording paper 16 conveyed by the conveyance belt 38, and thereby the occurrence of rubbing between the solvent absorbing roller 26 and the ink on the recording paper 16 is suppressed. In this way, disturbance of the image recorded on the recording paper 16 is prevented.

The base roller 26*a* has a cylindrical shape with a hollow interior, and a plurality of holes (not shown) are formed in the side faces thereof. The interior of the base roller 26*a* is adjusted to a negative pressure by applying suction by means of a suctioning apparatus, such as a solvent suctioning pump 43. The absorbing section 26*b* is pressed against the ink which has been separated into the coloring material component and the solvent component, and it principally absorbs the solvent component in the ink D, without absorbing the aggregate of the coloring material component.

Figure 8:
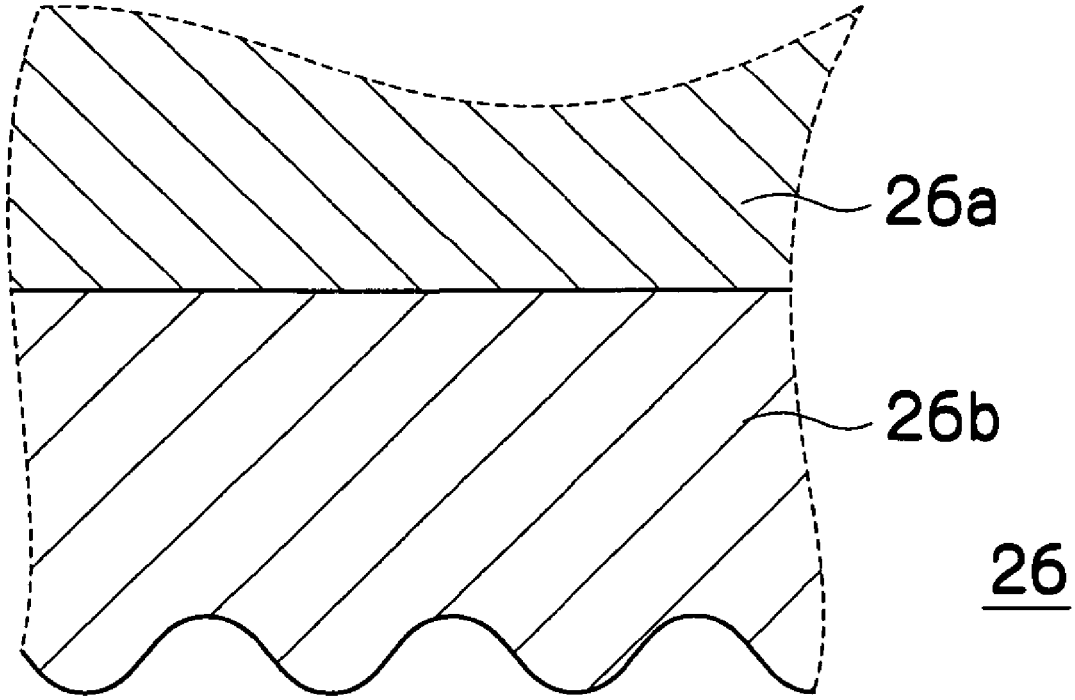
FIG. 8 is an enlarged diagram of one portion of a base roller and an absorbing section.

FIG. 8 is an enlarged view of one portion of the base roller 26*a* and absorbing section 26*b*. The surface of the absorbing section 26*b* which makes direct contact with the ink D has a continuous slight undulating shape, and the absorbing section 26*b* has good release characteristics with respect to the coloring material component of the ink D.

When the recording paper 16 is situated below the solvent absorbing roller 26, the solvent absorbing roller 26 having the above structure is pressed against the mixed liquid E2 on the recording paper 16, and absorbs the solvent layer E22 by means of a capillary action of the absorbing section 26*b* and the negative pressure inside the base roller 26*a* as shown in FIG. 7. Thereby, the majority of the solvent component in the mixed liquid E2 is absorbed by the solvent absorbing roller 26, and a mixed liquid E3 containing the aggregate of the coloring material component and a small amount of solvent component (for example, UV monomer) is produced. When the ink is fixed onto the recording paper 16 by irradiation of radiation by means of the radiation source 28, which is described later, it is desirable for the ink to contain some amount of solvent component. Therefore, the solvent absorbing roller 26 absorbs the solvent component from the mixed liquid E2 in such a manner that some amount of solvent component remains on the recording paper 16.

Desirably, a structure is adopted which does not apply a strong pressure to the image formed on the recording paper 16, when the solvent component is absorbed by means of the solvent absorbing roller 26. For example, desirably, the surface of the solvent absorbing roller 26 is formed so as to be soft, and the auxiliary roller 40 which opposes the solvent absorbing roller 26 is made of a soft material. Furthermore, desirably, the auxiliary roller 40 is disposed before or after the solvent absorbing roller 26 in terms of the conveyance direction of the recording paper 16, and thereby the auxiliary roller 40 is avoided to be positioned directly below the solvent absorbing roller 26. In this case, when the solvent absorbing roller 26 is pressed against the recording paper 16 and the pressure is applied to the recording paper 16, the deflection of the conveyance belt 38 occurs and thereby the pressure is alleviated.

The solvent component absorbed by the solvent absorbing roller 26 is absorbed into the interior of the solvent absorbing roller 26 by the negative pressure, pumped up by the solvent suction pump 43, and then sent to an externally located solvent recovery unit 25 via a recovery conveyance channel 45. Thereby, the performance of the solvent absorbing roller 26 in absorbing the solvent component on the recording paper 16 is kept substantially uniform, over the passage of time. The solvent component gathered in the solvent recovery unit 25 is passed through a filter, or the like, to remove impurities, and the monomer component is separated by centrifugal separation, chemical separation, or the like, whereupon the solvent component may be reused as the new ink by adding an ink component, such as coloring material component.

When the recording paper 16 is positioned below the radiation source 28, the radiation source 28 irradiates radiation toward the mixed liquid E3 on the recording paper 16, thereby curing the mixed liquid E3. For example, if the ink D is a UV-curable ink and the solvent component is a UV monomer, then a UV light source is used for the radiation source 28, and hence the mixed liquid E3 containing ink D can be cured by irradiating UV light (ultraviolet light) from the radiation source 28, toward the mixed liquid E3. Consequently, ink having a flattened thickness is fixed onto the recording paper 16, and the relief appearance in the image printed on the recording paper 16 is eliminated.

Desirably, a structure is adopted in which the amount of solvent component absorbed by the solvent absorbing roller 26 is adjusted suitably. For example, one of the following methods may be used: a method which varies and controls the distance between the solvent absorbing roller 26 and the recording paper 16 (or the solvent component) in accordance with the type of the recording paper 16, the conveyance speed of the recording paper 16, the amount of solvent component ejected, and/or the like; a method which varies and controls the pressure at which the solvent absorbing roller 26 is pressed against the recording paper 16; a method which controls the contact length (contact surface area) between the solvent absorbing roller 26 and the solvent component on the recording paper 16; a method which controls the contact time period between the solvent absorbing roller 26 and the solvent component on the recording paper 16, by adjusting the conveyance speed of the recording paper 16; and the like.

Next, concrete examples of the ink and the treatment liquid which can be used in the present embodiment will be described. In the present embodiment, it is possible to use an aqueous solution such as that described below, for example, as the treatment liquid and the ink.

In the present embodiment, it is possible to use, as the treatment liquid, an aqueous solution, for example, containing at least the following substances:

Sharol DC-902P, manufactured by Dai-Ichi Kogyo Seiyaku Co., Ltd.: 1 to 20 wt %; and Olfine E1010, manufactured by Nissin Chemical Industry Co., Ltd. (as a surface-active agent): 0.1 to 10 wt %.

The following substances can be added to this aqueous solution:

glycerol (as a high-boiling-point solvent): 0 to 30 wt %; and triethanolamine (as a pH adjuster): 0 to 10 wt %.

Figure 18A:
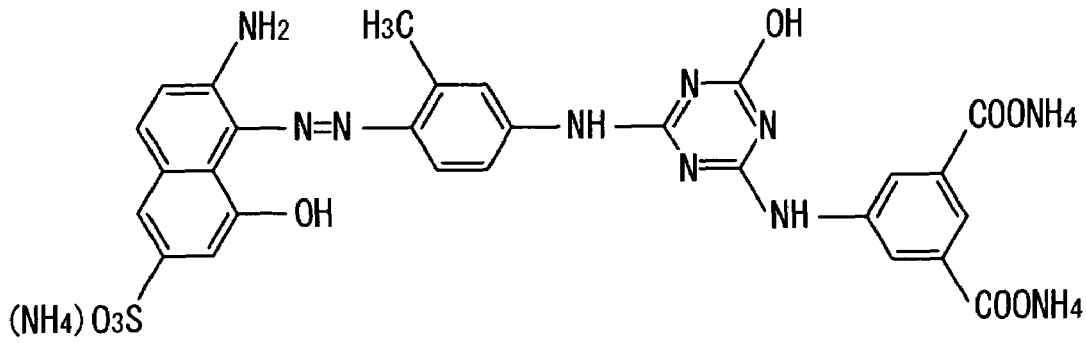
FIGS. 18A to 18C are structural formulas of examples of anionic dye compounds which the ink can include.
Figure 18B:
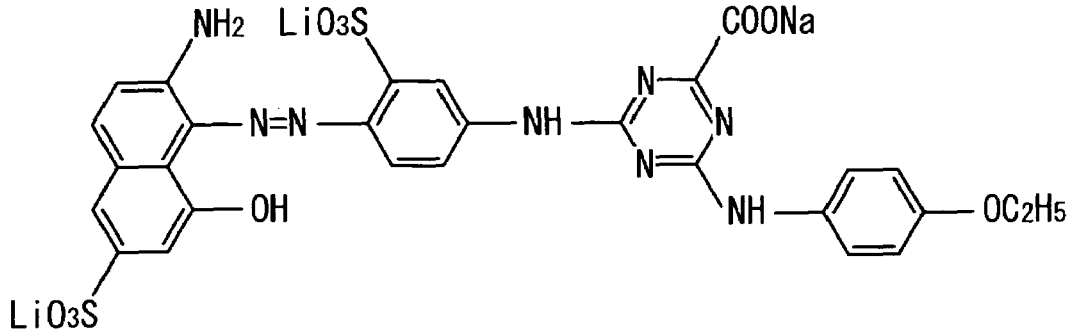
Figure 18C:
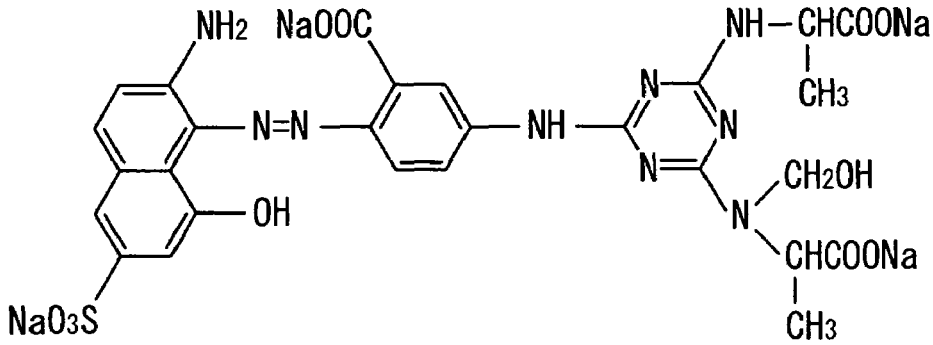

On the other hand, it is possible to use, as an ink containing a coloring material, an aqueous solution, for example, containing at least the following substances:

an anionic dye compound having the structure shown in FIG. 18A, 18B or 18C, for example: 1 to 30 wt %; and Olfine E1010, manufactured by Nissin Chemical Industry Co., Ltd. (as a surface-active agent): 0.1 to 10 wt %.

The following substances can be added to this aqueous solution:

polystyrene sodium sulfonate 0 to 20 wt %;

glycerol (as a high-boiling-point solvent): 0 to 30 wt %; and triethanolamine (as a pH adjuster): 0 to 10 wt %.

Next, the details of the structure of the solvent absorbing roller 26 will be described. Firstly, the absorbing section 26*b* included the solvent absorbing roller 26 will be described.

Figure 9:
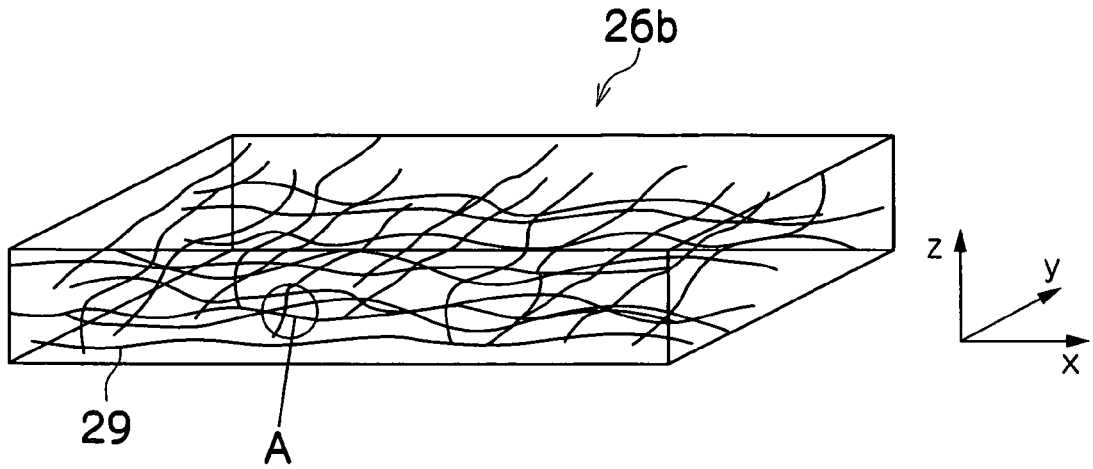
FIG. 9 is a diagram showing the internal structure of one example of an absorbing roller in the solvent absorbing roller, especially one portion of the absorbing roller.

FIG. 9 shows the internal structure of one example of the absorbing section 26*b* of the solvent absorbing roller 26, especially one portion of the absorbing section 26*b*. The X, Y and Z directions in the perpendicular coordinates system shown in FIG. 9 correspond to the X, Y and Z direction in the perpendicular coordinates system shown in FIG. 7. Therefore, the direction of conveyance of the recording paper 16, and the direction of the tangent to the circumference of the solvent absorbing roller 26 at the point where the absorbing section 26*b* makes contact with the recording paper 16, correspond to the X direction. Furthermore, the direction in which the solvent absorbing roller 26 is pressed against the recording paper 16, and the thickness direction of the absorbing section 26*b* at the point where it makes contact with the mixed liquid E2, and the radial direction of the solvent absorbing roller 26 at the point where the recording paper 16 and absorbing section 26*b* make contact, correspond to the Z direction (see FIG. 7).

As shown in FIG. 9, the absorbing section 26*b* in the present embodiment has a structure similar to that of absorbent paper, in other words, an infinite number of thread-like fibers 29 are woven together in the longitudinal direction (X direction) and lateral direction (Y direction). The fiber material 29 has a length which is substantially the same as that of the absorbing section 26*b* in the Y direction (see FIG. 7), and it is woven together in the X direction or Y direction. The absorbing section 26*b* is formed by layering an infinite number of fibers 29 extending in the X direction and Y direction, to a prescribed thickness in the Z direction.

Figure 10:
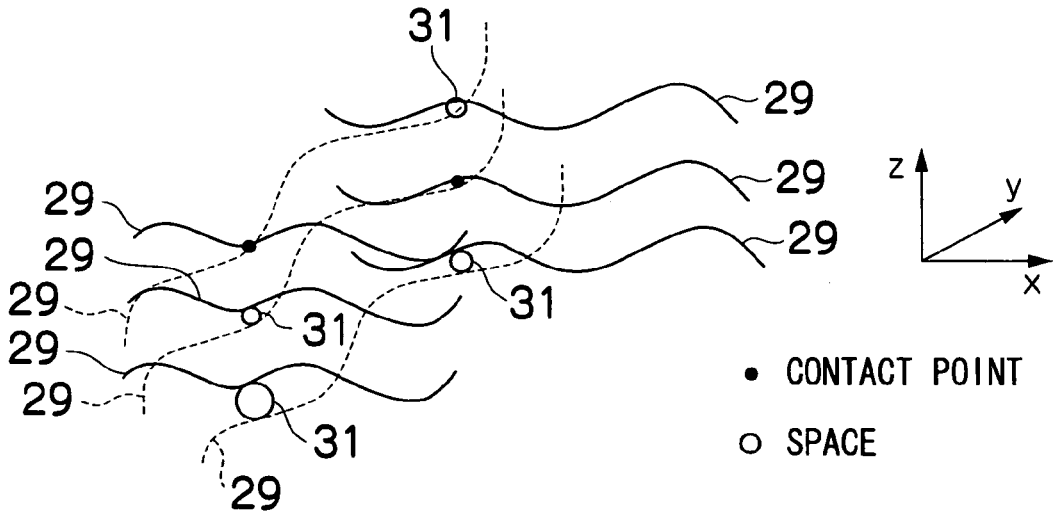
FIG. 10 is a diagram showing an enlarged view of one portion of the absorbing roller shown in FIG. 9, especially a typical example of the arrangement of fiber material.

FIG. 10 is an enlarged view of one portion of the absorbing section 26*b* shown in FIG. 9 (see section A in FIG. 9), especially a typical example of the arrangement of the fibers 29. In FIG. 10, the fibers 29 extending in the X-Z plane are illustrated by solid lines, and the fibers 29 extending in the Y-Z plane are illustrated by dotted lines. Furthermore, in FIG. 10, the black dots indicate contact points between the fibers 29 and the white dots indicate spaces between the fibers 29.

The absorbing section 26*b* is composed by weaving the fibers 29 together, but mutually adjacent fibers 29 are not necessarily in contact with each other. For example, the fibers 29 extending in the Y-Z plane (see dotted lines) shown in FIG. 10 may make contact (see black dots) or not make contact (see white dots) with the fibers 29 extending in the X-Z plane (see solid lines) which are located in the vicinity of same. In a location where a "fiber 29 extending in the Y-Z plane" and a "fiber 29 extending in the X-Z plane" do not make contact with each other and a space 31 is formed between the fibers 29, the space 31 plays a role of a "cushion", and thus a relatively high elasticity is provided in the Z direction. An absorbing section 26*b* having a structure in which the infinite number of fibers 29 are woven together in this way and including a lot of spaces 31, soaks up the solvent component that it comes into contact with, by capillary action.

The absorbing section 26*b* can be formed from a member made of cellulose such as pulp, natural fibers such as cotton, chemical fibers such as polypropylene or polyester, or the like. For example, products, such as "Kaydry" or "Kimtowel" made by CRECIA Corporation, or "ToraySee" made by Toray industries Inc., or the like, can be used.

In the absorbing section 26*b* made by weaving together the fibers 29 in the longitudinal direction (X direction) and lateral direction (Y direction) in this way and thereby containing spaces 31, the elastic modulus $E_a$ in the direction of pressing against the mixed liquid E2 on the recording paper 16 (Z direction) and the elastic modulus $E_b$ in a direction which is perpendicular to the pressing direction (X direction and Y direction) satisfy the following relationship (1):

$$E_a<E_b. \quad (1)$$

Next, the base roller 26*a* constituting the solvent absorbing roller 26 will be described. The base roller 26*a* in the present embodiment shown in FIG. 7 is made of rubber. This base roller 26*a* has no anisotropy in its elastic modulus properties, and hence has substantially the same elastic modulus in the X direction, the Y direction and the Z direction. The elastic modulus $E_r$ of the base roller 26*a* is a sufficiently large value compared to the elastic modulus $E_a$ in the Z direction of the absorbing section 26*b*, and for example, it may be set to a value which is approximately 100 times the elastic modulus $E_b$, for example.

By composing the solvent absorbing roller 26 as shown in FIG. 7 by combining the base roller 26*a* and the absorbing section 26*b* having elasticity of this kind, then the elastic modulus of the solvent absorbing roller 26 at the point of contact with the mixed liquid E2 on the recording paper 16 is as described below. More specifically, since the base roller 26*a* and the absorbing section 26*b* are arranged linearly in the Z direction at the point of contact with the mixed liquid E2, then the "elastic modulus in the Z direction of the solvent absorbing roller 26 at the point of contact with the mixed liquid E2" is substantially equal to the elastic modulus in the Z direction of the absorbing section 26*b*. On the other hand, the base roller 26*a* and the absorbing section 26*b* are disposed in parallel with respect to the X direction and the Y direction at the point of contact with the mixed liquid E2, and the thickness of the absorbing section 26*b* is relatively small. Hence, the "elastic modulus in the X direction and Y direction of the solvent absorbing roller 26 at the point of contact with the mixed liquid E2" is substantially equal to the elastic modulus in the X direction and the Y direction of the base roller 26*a*.

Figure 16:
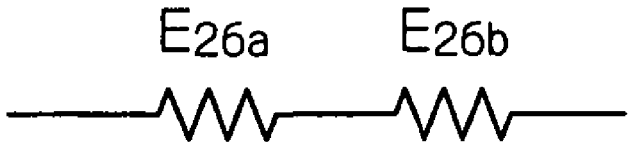
FIG. 16 is a diagram showing the relationship of the elastic modulus in the Z direction of the solvent absorbing roller at the point of contact with the mixed liquid.
Figure 17:
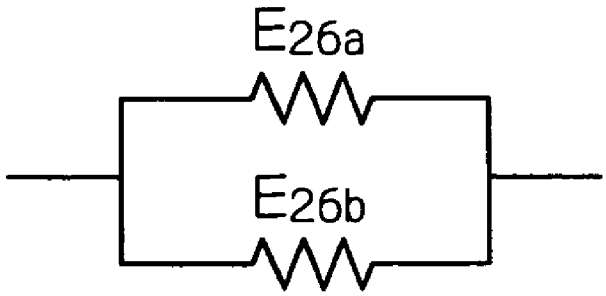
FIG. 17 is a diagram showing the relationship of the elastic modulus in the X direction or Y direction of the solvent absorbing roller at the point of contact with the mixed liquid.

FIG. 16 shows the relationship of the "elastic modulus in the Z direction of the solvent absorbing roller 26 (base roller 26*a* and absorbing section 26*b*) at the point of contact with the mixed liquid E2". FIG. 17 shows the relationship of the "elastic modulus in the X direction and Y direction of the solvent absorbing roller 26 (base roller 26*a* and absorbing section 26*b*) at the point of contact with the mixed liquid E2". The elastic modulus $E_{26a}$ of the base roller 26*a* and the elastic modulus $E_{26b}$ of the absorbing section 26*b* have the relationship: "$E_{26a}>>E_{26b}$". Therefore, the elastic modulus in the Z direction (pressing direction) of the solvent absorbing roller 26 can be "$E_{26a}+E_{26b}\approx E_{26b}$", as shown in FIG. 16. On the other hand, the elastic modulus of the solvent absorbing roller 26 in the X direction or Y direction (a direction perpendicular to the pressing direction) can be "$1/\{(E_{26a})+(1/E_{26b})\}\approx E_{26a}$", as shown in FIG. 17. Therefore, the "elastic modulus $E_{26b}$ in the Z direction (pressing direction)" and the "elastic modulus $E_{26a}$ in the X direction or the Y direction (direction perpendicular to the pressing direction)" in the solvent absorbing roller 26 satisfy the relationship "$E_{26b}<E_{26a}$", the solvent absorbing roller 26 is hard in the pressing direction (Z direction) and soft in the directions perpendicular to the pressing direction (X direction and Y direction), and accordingly it is possible to derive the following relationship.

In other words, in the "elastic modulus of the solvent absorbing roller 26 at the point of contact with the mixed liquid E2", the elastic modulus $E_c$ in the direction of pressing against the mixed liquid E2 on the recording paper 16 (Z direction) and the elastic modulus $E_d$ in the directions perpendicular to the pressing direction (X direction and Y direction) satisfy the following relationship (2):

$$E_c<E_d. \quad (2)$$

As one example, the elastic modulus $E_c$ described above may be set to approximately 0.03 ($N/mm^2$) and the elastic modulus $E_d$ may be set to approximately 0.3 ($N/mm^2$).

If a solvent absorbing roller 26 of this kind is used and the solvent absorbing roller 26 is pressed against the mixed liquid E2 on the recording paper 16, then the force applied to the absorbing body is relieved not only in the perpendicular directions (X direction and Y direction), but also in the pressing direction (Z direction). In particular, by making the elastic modulus $E_c$ in the pressing direction (Z direction) of the solvent absorbing roller 26 smaller than the elastic modulus $E_d$ in the perpendicular directions (X direction and Y direction) of the solvent absorbing roller 26, it is possible to effectively alleviate the impact applied to the solvent absorbing roller 26 in the pressing direction. Furthermore, by making the elastic modulus $E_c$ in the pressing direction (Z direction) of the solvent absorbing roller 26 greater than the elastic modulus $E_d$ in the perpendicular directions (X direction and Y direction) of the solvent absorbing roller 26, it is possible to suppress the amount of displacement of the solvent absorbing roller 26 in the perpendicular directions (X direction and Y direction) of the absorbing section 26*b*. By suppressing the amount of displacement of the absorbing section 26*b* in the perpendicular directions (X direction and Y direction), it is possible to prevent the coloring material component in the ink which makes contact with the absorbing section 26*b* from being displaced in the perpendicular directions (X direction and Y direction).

According to the present embodiment as described above, since the elastic modulus in the pressing direction (Z direction) of the solvent absorbing roller 26 and the elastic modulus in the perpendicular directions (X direction and Y direction) thereof are adjusted to satisfy the above-described relationships (1) and (2), then it is possible to effectively suppress deviation (displacement) of the ink in the perpendicular directions (X direction and Y direction) when the solvent absorbing roller 26 is pressed against the ink. Since the positional relationship in the perpendicular directions between the absorbing section 26*b* of the solvent absorbing roller 26 and the coloring material component of the ink is maintained as far as possible, when the absorbing section 26*b* makes contact with the coloring material component, then it is possible to reduce the force applied to the coloring material component in the perpendicular directions. Consequently, when the solvent component of the ink is absorbed by the solvent absorbing roller 26, it is possible to prevent the coloring material component from being rubbed away by the solvent absorbing roller 26.

Furthermore, since the solvent absorbing roller 26 in the present embodiment has a multiple-layer structure comprising the base roller 26*a* and the absorbing section 26*b*, it is possible to achieve a good balance between alleviating the force of impact in the pressing direction (Z direction) generated when the solvent absorbing roller 26 makes contact with the mixed liquid, and ensuring the rigidity of the solvent absorbing roller 26 in the perpendicular directions (X direction and Y direction).

Although the solvent absorbing roller 26 is made to rotate in such a manner that the relative speed of the solvent absorbing roller 26 with respect to the recording paper 16 is substantially zero, it is not absolutely necessary for the relative speed to be exactly zero. From the viewpoint of printing a clear image on the recording paper 16, desirably, the relative speed of the solvent absorbing roller 26 with respect to the recording paper 16 is as near as possible to zero, but the relative speed of the solvent absorbing roller 26 with respect to the recording paper 16 may be adjusted to within a range where the ink on the recording paper 16 is not disturbed by the contact with the solvent absorbing roller 26.

Second Embodiment

The present embodiment is substantially the same as the first embodiment described above, parts which are the same as those of the first embodiment being labeled with the same reference numerals and detailed description thereof being omitted here.

Figure 11:
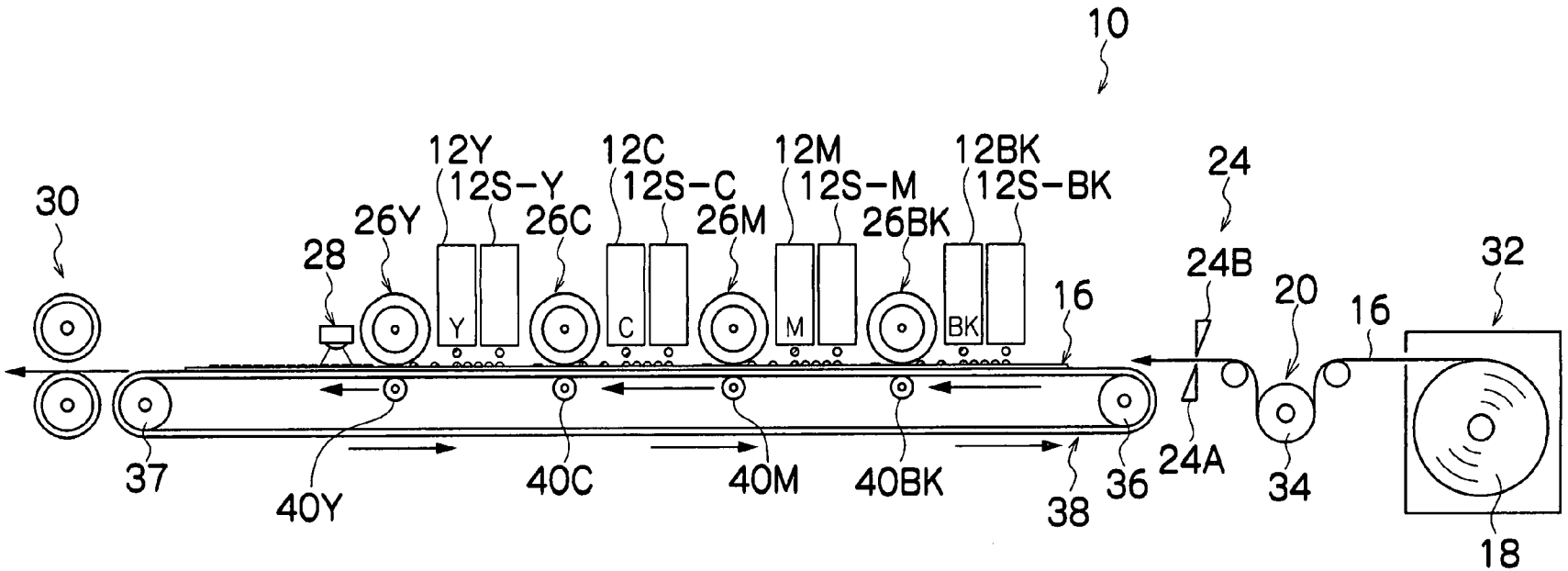
FIG. 11 shows a general view of the overall composition of the inkjet recording apparatus in a second embodiment.

FIG. 11 shows a general view of the overall composition of the inkjet recording apparatus 10 in a second embodiment. In the present embodiment, the treatment liquid heads, solvent absorbing rollers and auxiliary rollers are provided so as to correspond respectively to the print heads (ink heads) 12BK, 12M, 12C and 12Y.

With respect to the print heads 12BK, 12M, 12C and 12Y, treatment liquid heads 12S-BK, 12S-M, 12S-C and 12S-Y are provided respectively on the upstream side in terms of the conveyance direction of the recording paper 16, and solvent absorbing rollers 26BK, 26M, 26C and 26Y, and auxiliary rollers 40BK, 40M, 40C and 40Y, are provided respectively on the downstream side.

The radiation source 28 is situated at one position after the solvent absorbing roller 26Y corresponding to the Y (yellow) print head 12Y which is situated on the furthest downstream side of the print heads.

The remaining composition is substantially the same as that of the first embodiment described above. The treatment liquid heads 12S-BK, 12S-M, 12S-C and 12S-Y, the solvent absorbing rollers 26BK, 26M, 26C and 26Y, and the auxiliary rollers 40BK, 40M, 40C and 40Y in the present embodiment have substantially the same composition as the treatment liquid head 12S, the solvent absorbing roller 26 and the auxiliary roller 40 in the first embodiment described above.

In the present embodiment, processes for "ejecting treatment liquid S by means of the treatment liquid head", "ejecting ink D by means of the print head" and "absorbing and removing the solvent component by means of the solvent removal roller" are carried out with respect to each color of ink, similarly to those described in the first embodiment. After carrying out the processes of "ejecting treatment liquid S by means of the treatment liquid head", "ejecting ink D by means of the print head" and "absorbing and removing the solvent component by means of the solvent removal roller" for all of the ink colors, radiation is irradiated by the radiation source 28 onto the adjusted liquid formed by mixing of the ink and treatment liquid, and the ink is thereby cured on the recording paper 16.

In the present embodiment, by using solvent absorbing rollers 26BK, 26M, 26C and 26Y having the elastic modulus satisfying the above-described relationships (1) and (2), it is possible to effectively suppress deviation of ink in the perpendicular directions (X direction and Y direction) when the solvent absorbing rollers 26BK, 26M, 26C and 26Y are pressed against the ink.

Third Embodiment

The present embodiment is substantially the same as the second embodiment described above, parts which are the same as those of the second embodiment being assigned with the same reference numerals and detailed description thereof being omitted here.

Figure 12:
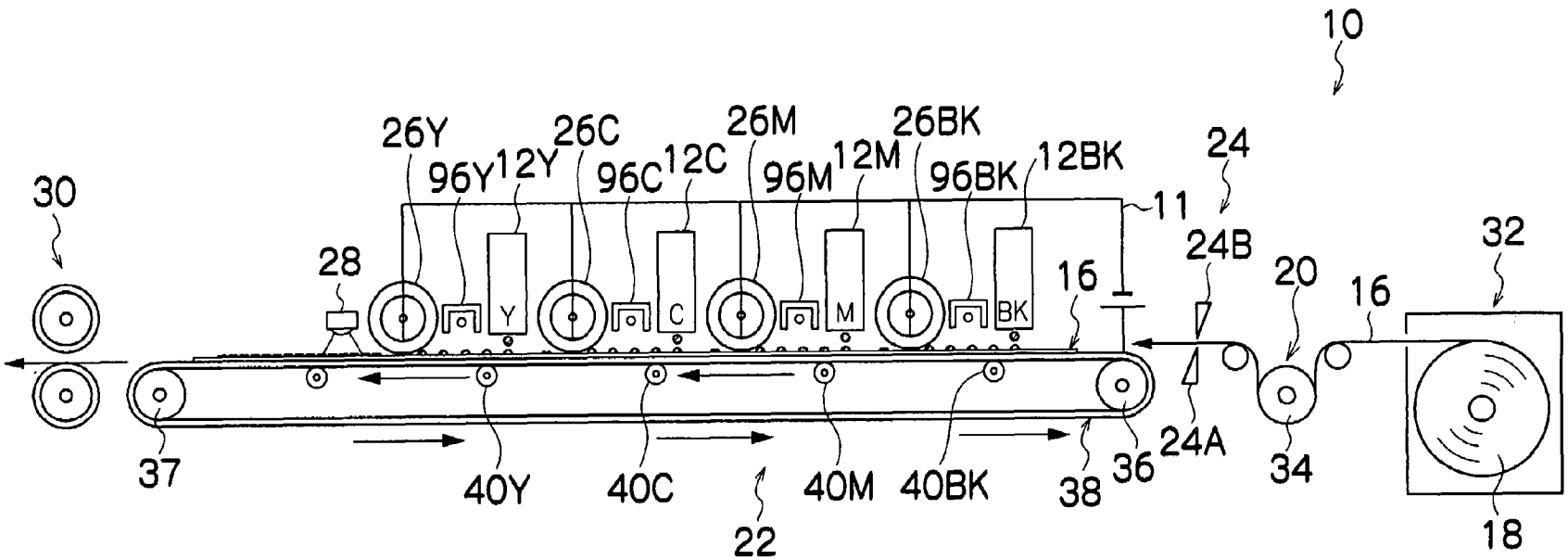
FIG. 12 shows a general view of the overall composition of the inkjet recording apparatus in a third embodiment.

FIG. 12 shows a general view of the overall composition of the inkjet recording apparatus 10 in a third embodiment. In order to separate the coloring material component and the solvent component in the ink ejected from the print heads 12BK, 12M, 12C and 12Y, the second embodiment described above relates to an example in which a treatment liquid is mixed with the ink. In contrast, in the present embodiment, a so-called electrophoretic effect is used. Therefore, in the present embodiment, corona chargers 96BK, 96M, 96C and 96Y are provided instead of the treatment liquid heads 12S-BK, 12S-M, 12S-C and 12S-Y.

As shown in FIG. 12, the auxiliary rollers 40BK, 40M, 40C and 40Y, the corona chargers 96BK, 96M, 96C and 96Y, and the solvent absorbing rollers 26BK, 26M, 26C and 26Y, are provided respectively successively from the upstream side to the downstream side in terms of the conveyance direction of the recording paper 16, after the print heads 12BK, 12M, 12C and 12Y The conveyance belt 38 is an electrostatic attraction belt made from a conducting member, and one end of a DC power supply 11 is electrically connected to the conveyance belt 38. The other end of the DC power supply 11 is electrically connected to the solvent absorbing rollers 26. When an electric field is applied between the conveyance belt 38 and the solvent absorbing rollers 26 by means of the DC power supply 11, the recording paper 16 is held on the conveyance belt 38 by means of an electrostatic attraction effect.

The remaining composition is substantially the same as the second embodiment described above.

The coloring material component of the ink ejected from the print heads 12BK, 12M, 12C and 12Y onto the recording paper 16 is charged by the corresponding corona chargers 96BK, 96M, 96C and 96Y. Using the electrophoretic effect, the ink on the recording paper 16 is separated into the coloring material component and the solvent component, and only the solvent component is absorbed and removed by the solvent absorbing roller 26. Thereupon, the coloring material component and solvent component remaining on the recording paper 16 are cured by radiation irradiated onto the radiation source 128. The separation of the solvent component and the removal of the solvent component by means of an electrorheological effect are described in detail below. Since the print heads 12BK, 12M, 12C and 12Y have substantially the same composition, then the print head 12Y is described in particular below.

Figure 13:
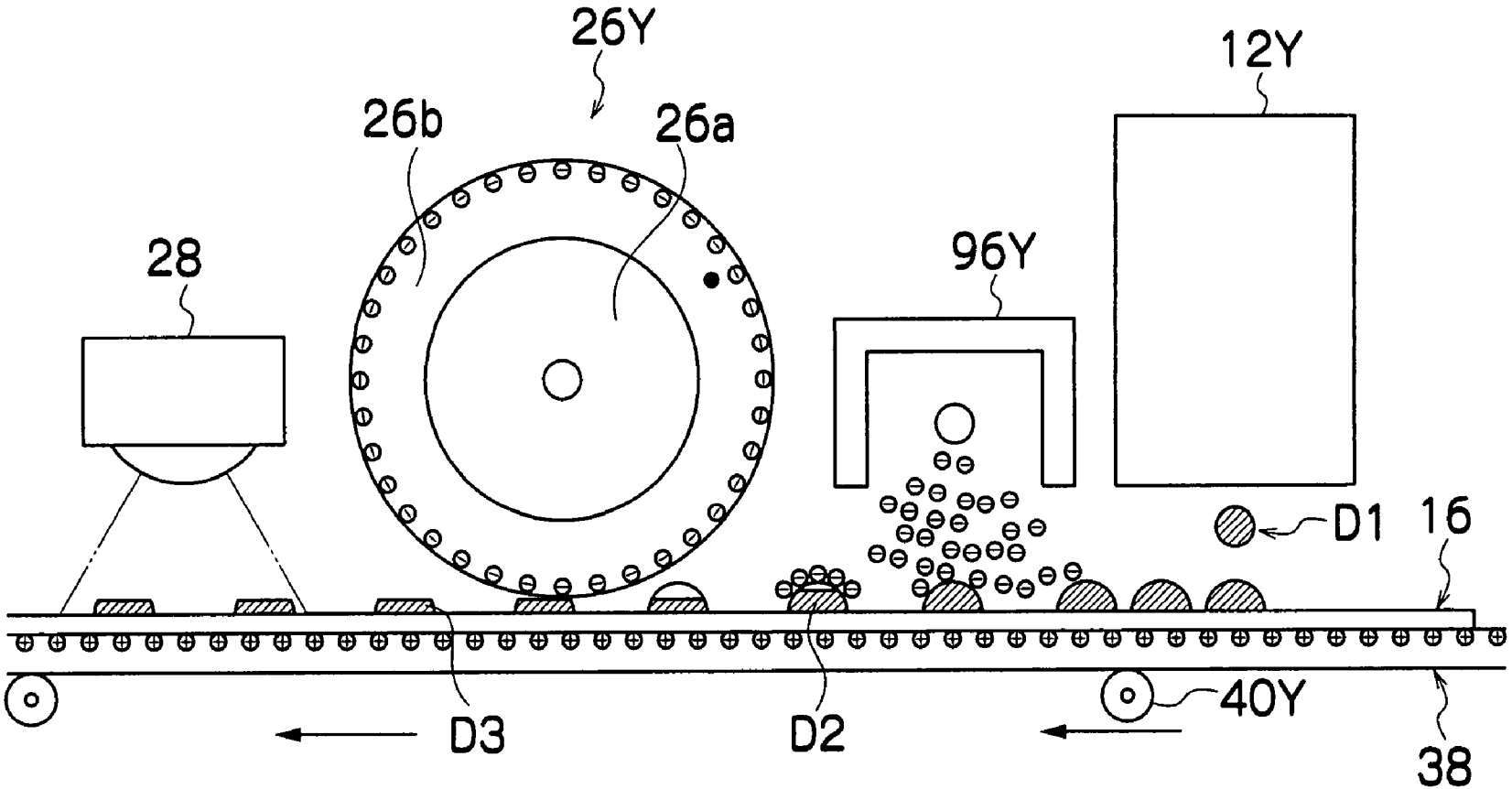
FIG. 13 is an enlarged diagram of the peripheral area of the print head for Y (yellow) ink.

FIG. 13 is an enlarged diagram of the peripheral area of the print head 12Y for Y (yellow) ink. In the present embodiment, an electric field is applied between the conveyance belt 38 and the solvent absorbing roller 26Y by the DC power supply 11 (see FIG. 12), and the conveyance belt 38 is charged positively, while the solvent absorbing roller 26Y is charged negatively. A droplet of ink D1 is ejected from the print head 12Y onto the recording paper 16 and the recording paper 16 onto which the ink D1 has been applied is conveyed by the conveyance belt 38. When the recording paper 16 comes to a position below the corona charger 96Y, then the corona charger 96Y carries out charge processing for the ink D1 applied to the recording paper 16, and thereby the coloring material component is charged negatively.

The negatively charged coloring material component gradually precipitates due to the electrostatic force of attraction which acts between the coloring material component and the positively charged conveyance belt 38. As the recording paper 16 approaches the solvent absorbing roller 26Y, the precipitation of the negatively charged coloring material component is promoted by the electrostatic force of repulsion which acts between the coloring material component and the negatively charged solvent absorbing roller 26Y. The ink D1 becomes ink D2 in which the coloring material component and solvent component are separated, due to the electrostatic force of attraction and the electrostatic force of repulsion created by the conveyance belt 38 and the solvent absorbing roller 26Y in this way. In this way, in the present embodiment, the DC power supply 11, the conveyance belt 38, the solvent absorbing roller 26Y, and the corona charger 96Y constitute a separating device which separates the coloring material component and solvent component.

When the recording paper 16 is conveyed to a position below the solvent absorbing roller 26Y, the solvent component of the ink D2 is absorbed and removed by the solvent absorbing roller 26Y, and the ink D2 becomes ink D3 which contains coloring material component and a small amount of solvent component. In this case, since the solvent absorbing roller 26Y is charged negatively, similarly to the coloring material component, then the absorption of coloring material component is suppressed and only the solvent component is effectively absorbed.

When the recording paper 16 is conveyed to a position below the radiation source 28, then radiation is irradiated onto the ink D3 from the radiation source 28, and the ink D3 is cured on the recording paper 16.

In the present embodiment, by using solvent absorbing rollers 26BK, 26M, 26C and 26Y having the elastic modulus satisfying the above-described relationships (1) and (2), it is possible to effectively suppress deviation of ink in the perpendicular directions (X direction and Y direction) when the solvent absorbing rollers 26BK, 26M, 26C and 26Y are pressed against the ink.

Fourth Embodiment

The present embodiment is substantially the same as the first embodiment described above, parts which are the same as those of the first embodiment being labeled with the same reference numerals and detailed description thereof being omitted here.

Figure 14A:
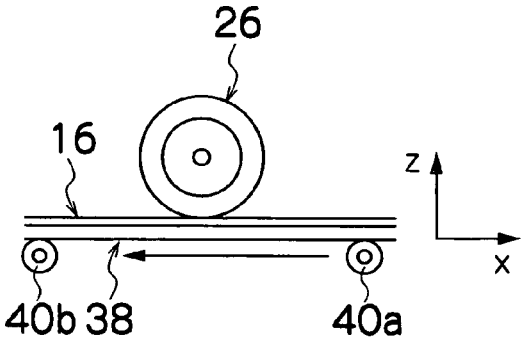
FIGS. 14A and 14B are diagrams which show the positional relationship between a solvent absorbing roller and auxiliary rollers in a fourth embodiment.
Figure 14B:
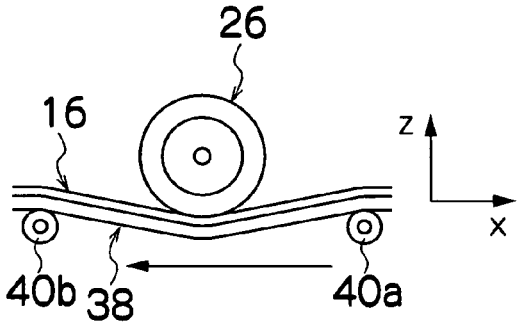

FIGS. 14A and 14B show the positional relationship between the solvent absorbing roller 26 and the auxiliary rollers 40*a* and 40*b* in the fourth embodiment. FIG. 14A shows a state where the pressing force of the solvent absorbing roller 26 against the recording paper 16 is relatively small, and FIG. 14B shows a state where the pressing force of the solvent absorbing roller 26 against the recording paper 16 is relatively large.

The auxiliary rollers 40*a* and 40*b* in the present embodiment are provided respectively on the upstream side and the downstream side in terms of the conveyance direction of the recording paper 16, with respect to the solvent absorbing roller 26 (before and after the solvent absorbing roller 26). The auxiliary rollers 40*a* and 40*b* and the solvent absorbing roller 26 are provided movably by means of a movement mechanism (not shown), and the pressing force of the solvent absorbing roller 26 against the recording paper 16 can be controlled by means of the positional relationship between the rollers.

For example, if the positions of the auxiliary rollers 40*a* and 40*b* and the solvent absorbing roller 26 are adjusted in such a manner that the recording paper 16 is conveyed substantially horizontally by the conveyance belt 38, as shown in FIG. 14A, then the pressing force of the solvent absorbing roller 26 against the recording paper 16 is small. Accordingly, the contact length (contact surface area) and contact time between the solvent absorbing roller 26 and the recording paper 16 (or the solvent thereon) become shorter, and consequently the amount of solvent component absorbed by the solvent absorbing roller 26 is reduced. On the other hand, if the positions of the auxiliary rollers 40*a* and 40*b* and the solvent absorbing roller 26 are adjusted in such a manner that the conveyance belt 38 and the recording paper 16 are bent downwards due to the pressing force of the solvent absorbing roller 26 against the recording paper 16, as shown in FIG. 14B, then the contact length (contact surface area) and the contact time between the solvent absorbing roller 26 and the recording paper 16 (solvent) become longer, and consequently the amount of solvent component absorbed by the solvent absorbing roller 26 becomes greater.

The remaining composition is substantially the same as that of the first embodiment described above.

By using the solvent absorbing roller 26 having elastic modulus satisfying the above-described relationships (1) and (2), even if a plurality of auxiliary rollers 40*a* and 40*b* are provided as in the present embodiment, it is possible to effectively suppress deviation of the ink in the perpendicular directions (X direction and Y direction) when the solvent absorbing roller 26 is pressed against the ink. In particular, in the present embodiment, since the auxiliary rollers 40*a* and 40*b* are provided on the upstream side and the downstream side in terms of the conveyance direction of the recording paper 16 with respect to the solvent absorbing roller 26, then it is possible to finely adjust the pressing force of the solvent absorbing roller 26 against the recording paper 16.

Fifth Embodiment

The present embodiment is substantially the same as the first embodiment described above, parts which are the same as those of the first embodiment being labeled with the same reference numerals and detailed description thereof being omitted here.

Figure 15B:
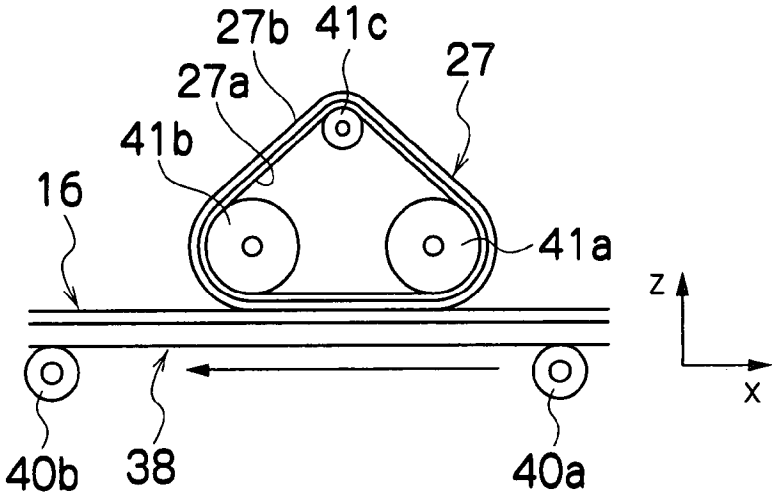
FIGS. 15A and 15B are diagrams for describing the method of adjusting the contact length (contact surface area) between the solvent absorbing body and the solvent component on the recording medium, in a fifth embodiment.
Figure 15A:
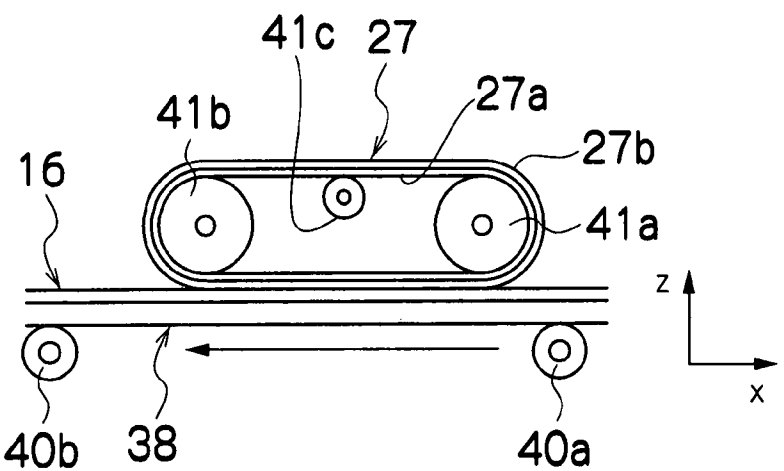

FIGS. 15A and 15B are diagrams for describing a method of adjusting the contact length between the solvent absorbing body and the solvent component on the recording paper 16, in a fifth embodiment. FIG. 15A shows a state where the contact length is relatively long and FIG. 15B shows a state where the contact length is relatively short.

In the examples shown in FIGS. 15A and 15B, instead of the roller-shaped solvent absorbing roller 26 as shown in FIG. 7, a solvent absorbing belt 27 wound around three rollers 41*a*, 41*b* and 41*c* is used. This solvent absorbing belt 27 moves in the same direction as the conveyance direction of the recording paper 16 conveyed by the conveyance belt 38, and it rotates about the rollers 41*a*, 41*b* and 41*c*, in such a manner that it has a relative speed of substantially zero with respect to the conveyance speed of the recording paper 16.

The solvent absorbing belt 27 has a layer-shaped base section 27*a* and an absorbing section 27*b* which is attached to the periphery of the base section 27*a*. The base section 27*a* is the part which makes contact with the rollers 41*a*, 41*b* and 41*c*, and it forms a member which supports the absorbing section 27*b*. The absorbing section 27*b* is formed in the shape of a thin layer, and it makes contact directly with the ink on the recording paper 16 and absorbs the solvent component thereof. The solvent component absorbed by the absorbing section 27*b* is sent to the solvent recovery unit 25 by means of a pump, or the like.

The elastic modulus of the solvent absorbing belt 27 is adjusted substantially similarly to the elastic modulus of the solvent absorbing roller 26 described above. In other words, the absorbing section 27*b* of the solvent absorbing belt 27 has a structure containing spaces 31 formed by weaving together the fibers 29 in the longitudinal direction (X direction) and lateral direction (Y direction), similarly to the absorbing section 26*b* of the solvent absorbing roller 26 (see FIG. 9 and FIG. 10). The relationship between the elastic modulus $E_e$ of the absorbing section 27*b* in the pressing direction (Z direction) against the ink on the recording paper 16, and the elastic modulus $E_f$ of the absorbing section 27*b* in the perpendicular directions to this pressing direction (X direction and Y direction) satisfy the following relationship (3):

$$E_e<E_f. \tag{3}$$

Furthermore, similarly to the base roller 26*a* of the solvent absorbing roller 26, the base section 27*a* of the solvent absorbing belt 27 has substantially the same elastic modulus $E_g$ in each of the X direction, Y direction and Z direction, and this elastic modulus $E_g$ is sufficiently larger than the elastic modulus $E_e$ of the absorbing section 27*b* in the Z direction. The "elastic modulus $E_h$ of the solvent absorbing belt 27 in the Z direction at the point of contact with the ink on the recording paper 16" is substantially equal to the elastic modulus of the absorbing section 27*b* in the Z direction, and the "elastic modulus $E_i$ of the solvent absorbing belt 27 in the X and Y directions at the point of contact with the ink on the recording paper 16" is substantially equal to the elastic modulus $E_g$ of the base section 27*a* in the X direction and Y direction. The solvent absorbing belt 27 satisfies the following relationship (4):

$$E_h<E_i. \tag{4}$$

Each of the rollers 41*a*, 41*b* and 41*c* is provided in a movable fashion by means of movement mechanisms (not shown); in particular, the roller 41*a* and roller 41*b* are provided in a movable fashion in the leftward and rightward directions, and the roller 41*c* is provided in a movable fashion in the upward and downward directions. By controlling the distance between the rollers 41*a*, 41*b* and 41*c*, it is possible to adjust the contact length (contact surface area) between the solvent absorbing belt 27 and the solvent component on the recording paper 16.

For example, if the roller 41*c* is placed in a lower position and the distance between the roller 41*a* and the roller 41*b* is increased as shown in FIG. 15A, then the contact length (contact surface area) between the solvent absorbing belt 27 and the recording paper 16 is increased, and thereby the amount of solvent component absorbed by the solvent absorbing belt 27 is increased. On the other hand, if the roller 41*c* is placed in an upper position and the distance between the roller 41*a* and the roller 41*b* is reduced as shown in FIG. 15B, then the contact length (contact surface area) between the solvent absorbing belt 27 and the recording paper 16 is reduced, and thereby the amount of solvent component absorbed by the solvent absorbing belt 27 is reduced.

The remaining composition is substantially the same as that of the first embodiment described above.

By using the solvent absorbing belt 27 which has the elastic modulus satisfying the above-described relationships (3) and (4), even if the belt-shaped solvent absorbing belt 27 is used as in the present embodiment, it is possible to effectively suppress deviation of the ink in the perpendicular directions (X direction and Y direction) when the solvent absorbing belt 27 presses against the ink.

The present invention is not limited to the embodiments described above or modifications thereof, and it may also be changed in terms of various design modifications, or the like, on the basis of the knowledge of those skilled in the art. Embodiments incorporated with such modifications also can fall within the scope of the present invention.

The present embodiments described above, for example, relate to the cases where one radiation source 28 is provided for a plurality of print heads (heads for ink); however, it is also possible to provide a plurality of radiation sources 28 so as to correspond to the print heads respectively. In this case, if a solvent removal device, such as a solvent absorbing roller 26 or solvent absorbing belt 27, is provided with respect to each of the print heads, after each of the print heads (ink heads) 12, then the radiation source 28 is desirably provided after each of the solvent removal devices.

Furthermore, the solvent absorbing body, such as the absorbing section 26*b* of the solvent absorbing roller 26 or the absorbing section 27*b* of the solvent absorbing belt 27, is not limited to the material and structure described above, provided that it has the elastic modulus satisfying the above-described relationships. For example, it is possible to use a sponge-type member having an infinite number of spaces, as the liquid absorbing body. By adjusting the density concerning the number of spaces and/or the volume with respect to each of the X direction, Y direction and the Z direction, it is possible to adjust the elastic modulus of the solvent absorbing body in such a manner that the above-described relationships are satisfied.

Furthermore, the embodiments described above relate to the examples where a solvent absorbing body is constituted by the roller-shaped solvent absorbing roller 26 or the belt-shaped solvent absorbing belt 27; however, any material or structure that is capable of removing the solvent component of the ink in a suitable manner can be used for the solvent absorbing body. For example, the liquid absorbing body may also be formed as a simple pad shape. Furthermore, the base roller 26*a* and the base section 27*a* can be made from a material such as metal or ceramic.

Furthermore, in the embodiments described above, the examples are described in which radiation is irradiated onto the ink remaining on the recording paper 16 after the solvent component of the ink is removed, thereby curing the ink; however, it is also possible to remove the unwanted solvent component after curing the coloring material component of the ink. If a water-based UV curing ink is used, for example, then the UV-curable monomer component or oligomer component contained in this UV-curable ink may be separated from the solvent component, such as water; the monomer component or oligomer component may be then cured by irradiation of ultraviolet light; whereupon the remaining solvent component may be removed.

When the solvent absorbing body makes contact with the ink on the recording paper 16, then by reducing the conveyance speed of the recording paper 16 or halting the conveyance of the recording paper 16, it is possible to effectively suppress the deviation (displacement) in the contact between the solvent absorbing body and the ink on the recording paper 16.

Furthermore, the above-described first embodiment or others relates to the case where only one type of treatment liquid is ejected from the treatment liquid head 12S; however, it is also possible to eject a plurality of different types of treatment liquid from the treatment liquid head 12S. The treatment liquid ejected from the treatment liquid head 12S is specified suitably in accordance with the types of ink ejected from the print head (ink head) 12BK, 12M, 12C and 12Y Furthermore, it is also possible to provide a plurality of treatment liquid heads 12S in accordance with the types of treatment liquid.

Furthermore, it is preferable that the treatment liquid is deposited on the recording paper 16 in a substantially uniform (substantially even) fashion in the region where ink droplets are to be ejected, and it is not necessary to form treatment liquid dots to a high density, in comparison with the ink. Therefore, it is also possible to reduce the number of nozzles and the nozzle density in the treatment liquid head, in comparison with the print heads (ink heads). Furthermore, it is also possible to make the nozzle diameter of the treatment liquid head greater than the nozzle diameter of the print heads.

Moreover, the embodiments described above relate to the examples where the ink is cured by irradiating radiation; however, it is also possible to use other methods for fixing the ink onto the recording paper 16. The present invention may also be applied to cases adopting a method where the coloring material of the ink permeates into the recording medium; a method where the coloring material component remains on the recording medium by evaporating the solvent component of the ink and/or permeating into the recording medium; or a method where the coloring material component is cured on the recording medium by means of a technique other than irradiating radiation.

Furthermore, the embodiments described above relate to the examples where the treatment liquid is deposited on the recording paper 16 by means of the treatment liquid head adopting an inkjet system; however, the present invention may also be applied to cases where the treatment liquid is applied to the recording paper 16 by using a member such as a roller, brush, blade, or the like.

Furthermore, it is also possible to apply the present invention to a liquid other than ink, provided that the liquid is one which contains a coloring material and a solvent, in which the coloring material and the solvent can be separated by means of a prescribed technique.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

an object liquid ejection device which ejects object liquid containing coloring material and solvent, onto a recording medium;

a separating device which separates the coloring material and the solvent in the object liquid ejected on the recording medium; and a solvent removal device including an absorbing body which absorbs the solvent, the absorbing body being pressed against the object liquid in which the coloring material and the solvent are separated by the separating device, wherein an elastic modulus $E_n$ of the absorbing body in a pressing direction in which the absorbing body is pressed against the object liquid ejected on the recording medium, and an elastic modulus $E_s$ of the absorbing body in an orthogonal direction perpendicular to the pressing direction, satisfy the following relationship: $E_n<E_s$.

2. The image forming apparatus as defined in claim 1, wherein:

the absorbing body includes a surface layer which makes direct contact with the object liquid and a supporting layer which supports the surface layer; and an elastic modulus $E_{n1}$ of the surface layer in the pressing direction and an elastic modulus $E_{n2}$ of the supporting layer in the orthogonal direction satisfy the following relationship: $E_{n1}<E_{n2}$.

* * * * *